US009240196B2

(12) United States Patent
Disch et al.

(10) Patent No.: US 9,240,196 B2
(45) Date of Patent: Jan. 19, 2016

(54) APPARATUS AND METHOD FOR HANDLING TRANSIENT SOUND EVENTS IN AUDIO SIGNALS WHEN CHANGING THE REPLAY SPEED OR PITCH

(75) Inventors: Sascha Disch, Fuerth (DE); Frederik Nagel, Nuremberg (DE); Stephan Wilde, Wendelstein (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 701 days.

(21) Appl. No.: 13/604,813

(22) Filed: Sep. 6, 2012

(65) Prior Publication Data

US 2013/0060367 A1 Mar. 7, 2013

Related U.S. Application Data

(63) Continuation of application No. PCT/EP2011/053303, filed on Mar. 4, 2011.

(60) Provisional application No. 61/312,131, filed on Mar. 9, 2010.

(51) Int. Cl.

| | |
|---|---|
| ***G10L 21/038*** | (2013.01) |
| ***G10L 21/04*** | (2013.01) |
| *G10L 19/025* | (2013.01) |

(52) U.S. Cl.

CPC ..... *G10L 21/038* (2013.01); *G10L 21/04* (2013.01); *G10L 19/025* (2013.01)

(58) Field of Classification Search

CPC ..... G10L 19/008; G10L 21/038; G10L 25/18
USPC ..... 704/200–201, 500–501
See application file for complete search history.

(56) References Cited

U.S. PATENT DOCUMENTS 5,455,888 A 10/1995 Iyengar et al.
6,549,884 B1 * 4/2003 Laroche et al. ..... 704/207

(Continued)

FOREIGN PATENT DOCUMENTS

CN 1511312 7/2004
CN 101471072 7/2009

(Continued)

OTHER PUBLICATIONS

Duxbury, C et al., "Separation of Transient Information in Musical Audio Using Multiresolution Analysis Techniques", Proceedings of the COST G-6 Conference on Digital Audio Effects (DAFX-01). Limerick, Ireland., Dec. 6, 2001, 1-4.

(Continued)

*Primary Examiner* — Douglas Godbold
(74) *Attorney, Agent, or Firm* — Michael A. Glenn; Perkins Coie LLP

(57) ABSTRACT

An apparatus for processing an audio signal has an overlap-add stage for overlapping and adding blocks of a corresponding one of a plurality of subband signals using an overlap-add-advance value being different from a block extraction advance value. The apparatus further has a transient detector for detecting a transient in the audio signal or a subband signal of the plurality of subband signals. The overlap-add stage is configured for reducing an influence of a detected transient or for not using the detected transients when adding. The apparatus further has a transient adder for adding a detected transient to a subband signal generated by the overlap/add stage. A related method for processing an audio signal has, inter alia, either reducing an influence or discarding a detected transient when overlapping and adding.

18 Claims, 17 Drawing Sheets

(56) References Cited

U.S. PATENT DOCUMENTS

| | | | | |
|---|---|---|---|---|
| 6,766,300 | B1 * | 7/2004 | Laroche | 704/500 |
| 6,895,375 | B2 | 5/2005 | Malah et al. | |
| 7,337,108 | B2 * | 2/2008 | Florencio et al. | 704/208 |
| 7,917,360 | B2 * | 3/2011 | Rogers | 704/229 |
| 8,296,159 | B2 | 10/2012 | Neuendorf | |
| 2003/0187663 | A1 | 10/2003 | Truman et al. | |
| 2004/0125878 | A1 * | 7/2004 | Liljeryd et al. | 375/242 |
| 2004/0176961 | A1 * | 9/2004 | Manu et al. | 704/500 |
| 2006/0239473 | A1 | 10/2006 | Kjorling et al. | |
| 2007/0071116 | A1 | 3/2007 | Oshikiri et al. | |
| 2007/0078650 | A1 | 4/2007 | Rogers et al. | |
| 2007/0285815 | A1 * | 12/2007 | Herre et al. | 360/13 |
| 2008/0222228 | A1 | 9/2008 | Halle | |
| 2009/0063140 | A1 | 3/2009 | Villemoes et al. | |
| 2009/0234646 | A1 | 9/2009 | Kjorling et al. | |
| 2009/0276069 | A1 * | 11/2009 | Rogers | 700/94 |
| 2010/0003543 | A1 | 1/2010 | Zhou | |
| 2010/0085102 | A1 * | 4/2010 | Lee et al. | 327/334 |
| 2010/0114583 | A1 * | 5/2010 | Lee et al. | 704/500 |
| 2011/0004479 | A1 * | 1/2011 | Ekstrand et al. | 704/500 |
| 2011/0208517 | A1 * | 8/2011 | Zopf | 704/211 |
| 2012/0195442 | A1 * | 8/2012 | Villemoes et al. | 381/98 |

FOREIGN PATENT DOCUMENTS

| | | |
|---|---|---|
| EP | 1940023 | 7/2008 |
| EP | 2214165 | 4/2010 |
| JP | S55-107313 | 8/1980 |
| JP | 2001-521648 | 11/2001 |
| JP | 2004-053895 | 2/2004 |
| JP | 2004-053940 | 2/2004 |
| JP | 2004-206129 | 7/2004 |
| JP | 2005-128387 | 5/2005 |
| JP | 2005-521907 | 7/2005 |
| JP | 2007-017628 | 1/2007 |
| JP | 2007-101871 | 4/2007 |
| JP | 2009-519491 | 5/2009 |
| TW | 200939211 | 9/2009 |
| TW | 201007701 | 2/2010 |
| WO | WO-9857436 | 12/1998 |
| WO | WO-02084645 | 10/2002 |
| WO | WO-2005040749 | 5/2005 |
| WO | WO-2009078681 | 6/2009 |
| WO | WO-2009/095169 | 8/2009 |
| WO | WO-2009112141 | 9/2009 |
| WO | WO-2010003557 | 1/2010 |
| WO | WO-2010069885 | 6/2010 |
| WO | WO-2010086461 | 8/2010 |
| WO | WO-2011054885 | 5/2011 |

OTHER PUBLICATIONS

Flanagan, J et al., "Phase Vocoder", The Bell System Technical Journal, Nov. 1966, 1493-1509.

Frederik, Nagel et al., "A Phase Vocoder Driven Bandwidth Extension Method with Novel Transient Handling for Audio Codecs", XP040508993; Convention Paper 7711; Presented at the 126th Convention; May 7-10, 2006; Munich, Germany, 1-8.

Laroche, J et al., "Improved Phase Vocoder Time-Scale Modification of Audio", IEEE Transactions on Speech and Audio Processing. vol. 7, No. 3, May 1999, 323-332.

Laroche, J et al., "New Phase-Vocoder Techniques for Pitch-Shifting, Harmonizing and Other Exotic Effects", Proc. IEEE Workshop on App. of Signal Proc. to Signal Proc. to Audio and Acous. New Paltz, New York, USA., Oct. 17, 1999, 91-94.

Ravelli, E et al., "Fast Implementation for Non-Linear Time-Scaling of Stereo Signals", Proc. of the 8th Int. Conference on Digital Audio Effects (DAFx'05). Madrid, Spain., Sep. 20, 2005, 1-4.

Robel, A et al., "A New Approach to Transient Processing in the Phase Vocoder", Proc. of the 6th Int. Conference on Digital Audio Effects (DAFX-03). London, UK., Sep. 8, 2003, 1-6.

"ISO/IEC 14496-3, 4.6.18.4.2", Synthesis Filterbank, 2005, pp. 220-221.

"ISO/IEC 14496-3: 2005 ( E ) section 4.6.8", Joint Coding, 2005, pp. 150-157.

"ISO/IEC 14496-3", Information technology—Coding of audio visual objects—Part 3: Audio, 2009, 1416 Pages (Document broken into 7 parts for IDS upload).

Aarts, R et al., "A Unified Approach to Low- and High Frequency Bandwidth Extension", In AES 115th Convention. New York, New York, USA., Oct. 2003, pp. 1-16.

Arora, M et al., "High Quality Blind Bandwidth Extension of Audio for Portable Player Applications", Presented at the 120th AES Convention. Paris, France, May 20, 2006, pp. 1-6.

Dietz, M et al., "Spectral Band Replication, a Novel Approach in Audio Coding", Presented at the 112th AES Convention. Munich, Germany., May 10, 2002, pp. 1-6.

Disch, S et al., "An Amplitude-and Frequency-Modulation Vocoder for Audio Signal", Proceedings of the 11th International Conference on Digital Audio Effects (DAFx-08). Espoo, Finland., Sep. 1, 2008, pp. 1-7.

Fielder, L et al., "Introduction to Dolby Digital Plus, an Enhancement to the Dolby Digital Coding System", Presented at the 117the Convention. San Francisco, CA, USA., Oct. 28, 2004, 1-29.

Geiser, et al., "Bandwidth Extension for Hierarchical Speech and Audio Coding in ITU-T Tec. G.729.1", IEEE Transactions on Audio, Speech, and Language Processing, vol. 15, No. 8, Nov. 2007.

Henn, F et al., "Spectral Band Replications (SBR) Technology and its Application in Broadcasting", 112th AES Convention. Munich, Germany, pp. 423-430, 2003.

Herre, J et al., "MP3 Surround: Efficient and Compatible Coding of Multi-Channel Audio", Presented at the 116th Cony. Aud. Eng. Soc. Berlin, Germany., 14 Pages, May 8, 2004.

Hsu, H et al., "Audio Patch Method in MPEG-4 HE-AAC Decoder", Presented at the 117th AES Convention. San Francisco, CA, USA., pp. 1-11, Oct. 28, 2004.

Huan, Zhou et al., "Core Experiment on the eSBR module of USAC", 90. MPEG Meeting; Oct. 26, 2009-Oct. 30, 2009; Xian; (Motion Picture Expert Group of ISO/IECT JTC1/SC29/WG11); Oct. 23, 2009.

Iyengar, V et al., "International Standard ISO/IEC 14496-3:2001/FPDAM 1: Bandwidth Extension", Speech Bandwidth Extension Method and Apparatus, 405 Pages, Oct. 2002.

Kayhko, "A Robust Wideband Enhancement for Narrowband Speech Signal", Research Report, Helsinki Univ. of Technology, Laboratory of Acoustics and Audio Signal Processing, 75 Pages, 2001, cited in Kallio, Laura "Artificial Bandwidth Expansion of Narrowband Speech in Mobile Communication Systems", Master's Thesis, Helsinki University, p. 65, Dec. 9, 2002.

Larsen, E et al., "Audio Bandwidth Extension—Application to Psychoacoustics, Signal Processing and Loudspeaker Design", John Wiley & Sons, Ltd., 33 Pages, 2004.

Larsen, E et al., "Efficient High-Frequency Bandwidth Extension of Music and Speech", In AES 112th Convention. Munich, Germany., pp. 1-5, May 2002.

Makhoul, J et al., "Spectral Analysis of Speech by Linear Prediction", IEEE Transactions on Audio and Electroacoustics. vol. AU-21, No. 3., pp. 140-148, Jun. 1973.

Meltzer, S et al., "SBR enhanced audio codecs for digital broadcasting such as "Digital Radio Mondiale" (DRM)", AES 112th Convention. Munich, Germany, 4 Pages, May 2002.

Nagel, F et al., "A Harmonic Bandwidth Extension Method for Audio Codecs", ICASSP International Conference on Acoustics, Speech and Signal Processing. IEEE CNF. Taipei, Taiwan, pp. 145-148, Apr. 2009.

Nagel, F et al., "A Phase Vocoder Driven Bandwidth", 126th AES Convention, Munich, Germany, pp. 1-8, May 2009.

Neuendorf, M et al., "A Novel Scheme for Low Bitrate Unified Speech and Audio Coding", Presented at the 126th AES Convention. München, Germany, pp. 1-13, May 2009.

Neuendorf, M et al., "Unified Speech and Audio Coding Scheme for High Quality at Lowbitrates", ICASSP, 1-4, 2009.

Puckette, M et al., "Phase-locked Vocoder", IEEE ASSP Conference on Applications of Signal Processing to Audio and Acoustics. Mohonk, New York, USA., 4 Pages, 1995.

(56) References Cited

OTHER PUBLICATIONS

Robel, A et al., "Transient Detection and Preservation in the Phase Vocoder", ICMC '03. Singapore. Link provided: citeseer.ist.psu.edu/679246.html, pp. 247-250, 2003.

Zhong, Haishan et al., "Finalization of CE on QMF based harmonic transposer", 94. MPEG Meeting; Oct. 11, 2010-Oct. 15, 2010; Guangzhou; (Motion Picture Expert Group or ISO/IEC JTC1/SC29/WG11); Oct. 28, 2010.

Zhou, Huan et al., "Finalization of CE on QMF based harmonic transposer", 93. MPEG Meeting; Jul. 26, 2010-Jul. 30, 2010; Geneva; (Motion Picture Expert Group of ISO/IEC JTC1/SC29/WG11), Jul. 22, 2010.

Ziegler, T et al., "Enhancing mp3 with SBR: Features and Capabilities of the new mp3PRO Algorithm", Presented in the 112th AES Convention. Munich, Germany., pp. 1-7, May 10, 2002.

"ISO/IEC JTC 1 Directives, 5th Edition, Version 3.0", Apr. 5, 2007, pp. 1-212, XP055182104 [retrieved on Apr. 10, 2015].

Audio Subgroup: "MPEG Audio CE Methodology", Apr. 25, 2009, XP055182357 [retrieved on Apr. 13, 2015].

Hods: "MPEG 101", Jan. 31, 2005, XP055182379, [retrieved on Apr. 13, 2015].

Webmaster: "Geneva Meeting—Document Register 93. MPEG meeting; Jul. 26, 2010—Jul. 30, 2010; Geneva; (Motion Picture Expert Group or ISO/IEC JTC1/SC29/WG11)", Jul. 29, 2010, XP055182371, [retrieved on Apr. 13, 2015].

Webmaster: "Guangzhou Meeting—Document Register. 94. MPEG meeting; Oct. 11, 2010-Oct. 15, 2010; Guangzhou; (Motion Picture Expert Group or ISO/IEC JTC1/SC29/WG11)", Jan. 15, 2011, XP055182374, [retrieved on Apr. 13, 2015].

* cited by examiner

APPARATUS AND METHOD FOR HANDLING TRANSIENT SOUND EVENTS IN AUDIO SIGNALS WHEN CHANGING THE REPLAY SPEED OR PITCH

CROSS-REFERENCE TO RELATED APPLICATIONS

This application is a continuation of copending International Application No. PCT/EP2011/053303, filed Mar. 4, 2011, which is incorporated herein by reference in its entirety, and additionally claims priority from U.S. Patent Application No. 61/312,131, filed Mar. 9, 2010, which is incorporated herein by reference in its entirety.

BACKGROUND OF THE INVENTION

The replay speed of audio signals can be changed while maintaining the pitch, for example with the help of a phase vocoder (see for example J. L. Flanagan and R. M. Golden, "The Bell System Technical Journal", November 1966, pages 1394 to 1509; U.S. Pat. No. 6,549,884 Laroche, J. & Dolson, M.: "Phase-vocoder pitch-shifting"; Jean Laroche and Mark Dolson, "New Phase-Vocoder Techniques for Pitch-Shifting, Harmonizing And Other Exotic Effects", Proc. 1999 IEEE Workshop on Applications of Signal Processing to Audio and Acoustics, New Paltz, N.Y., Oct. 17-20, 1999). In the same way, with such methods transposition of the signal can be performed while maintaining the original replay duration. The latter is obtained by replaying the stretched signal accelerated by the factor of time stretching. In time discrete signal representation, this corresponds to down-sampling the signal by the stretching factor while maintaining the sampling frequency. Conventionally, this time stretching takes place in the time domain. Alternatively, the same can also take place within a filter bank, such as a pseudo-quadrature mirror filterbank (pQMF). The pseudo-quadrature mirror filterbank (pQMF) is sometimes also called a QMF filterbank.

Specific challenges in stretching are transient events that are "blurred" in time during the processing step of time stretching. This occurs because methods, such as the phase vocoder, affect the so-called vertical coherence properties (with regard to a time frequency spectrogram representation) of the signal.

Some current methods stretch the time more around the transients, in order to not have to perform any or only little time stretching during the duration of the transient. This has been described, for example, in:

- Laroche L., Dolson M.: Improved phase vocoder timescale modification of audio", IEEE Trans. Speech and Audio Processing, vol. 7, no. 3, pp. 323-332
- Emmanuel Ravelli, Mark Sandler and Juan P. Bello: Fast implementation for non-linear time-scaling of stereo audio; Proc. of the 8th Int. Conference on Digital Audio Effects (DAFx'05), Madrid, Spain, Sep. 20-22, 2005
- Duxbury, C., M. Davies, and M. Sandler (2001, December). Separation of transient information in musical audio using multi resolution analysis techniques. In Proceedings of the COST G-6 Conference on Digital Audio Effects (DAFX-01), Limerick, Ireland.

Another paper on the topic was written by Röbel, A.: A NEW APPROACH TO TRANSIENT PROCESSING IN THE PHASE VOCODER; Proc. of the 6th Int. Conference on Digital Audio Effects (DAFx-03), London, UK, Sep. 8-11, 2003.

In time stretching of audio signals by phase vocoders, transient signal portions are "blurred" by dispersions, since the so-called vertical coherency in spectrogram view of the signal is affected. Methods operating with so-called overlap-add methods can generate spurious pre echoes and post echoes of transient sound events. These problems can be handled by changing time stretching in the environment of transients, no stretching during the actual transients and stronger stretching in the surrounding. If, however, transposition is to take place, the transposition factor will no longer be constant in the environment of the transients, i.e. the pitch of superimposed (possibly tonal) signal portions changes in a spuriously audible manner. When time stretching takes place within a filter bank, such as the pQMF, similar problems occur.

The field of this application relates to a method for perceptually motivated handling of transient sound events within such a process. In particular, transient sound events may be removed during signal manipulation of time stretching. Subsequently, a precisely fitting addition may be performed of the unprocessed transient signal portion to the changed (stretched) signal under consideration of the stretching.

SUMMARY

According to an embodiment, an apparatus for processing an audio signal may have an analysis filterbank for generating subband signals of the audio signal; a time manipulator for individually time manipulating a plurality of subband signals representing the audio signal, wherein the time manipulator may have an overlap-add stage for overlapping and adding blocks of at least one of the plurality of subband signals using an overlap-add-advance value different from a block-extraction-advance value used for extracting the blocks from a subband signal of the plurality of subband signals; a transient detector for detecting a transient in the audio signal or the at least one subband signal of the plurality of subband signals, wherein the overlap-add stage is configured for reducing an influence of a detected transient or for not using the detected transients in a subband-individual manner when adding by the overlap-add stage; and a transient adder for adding a detected transient to the at least one subband signal generated by the overlap/add stage in a subband-individual manner.

According to another embodiment, a method for processing an audio signal may have the steps of generating a plurality of subband signals of the audio signal; overlapping and adding blocks of a corresponding one of the plurality of subband signals representing the audio signal using an overlap-add-advance value different from a block-extraction-advance value used for extracting the blocks from a subband signal of the plurality of subband signals; detecting a transient in the at least one subband signal of the plurality of subband signals; either reducing an influence or discarding a detected transient when overlapping and adding in a subband-individual manner; adding a detected transient to the at least one subband signal generated by the action of overlapping and adding in a subband-individual manner.

According to another embodiment, a computer program may perform a method for processing an audio signal when the computer program runs on a computer, wherein the method may have the steps of generating a plurality of subband signals of the audio signal; overlapping and adding blocks of a corresponding one of the plurality of subband signals representing the audio signal using an overlap-add-advance value different from a block-extraction-advance value used for extracting the blocks from a subband signal of the plurality of subband signals; detecting a transient in the at least one subband signal of the plurality of subband signals; either reducing an influence or discarding a detected transient when overlapping and adding in a subband-individual manner; adding a detected transient to the at least one subband signal generated by the action of overlapping and adding in a subband-individual manner.

According to embodiments of the teachings disclosed in this document, an apparatus for processing an audio signal, comprises a time manipulator for individually time manipulating a plurality of subband signals of the audio signal. The time manipulator comprises an overlap-add stage for overlapping and adding blocks of at least one of the plurality of subband signals using an overlap-add-advance value being different from a block extraction advance value, a transient detector for detecting a transient in the audio signal or a subband signal, and a plurality of transient adders for adding a detected transient to a plurality of signals generated by the overlap-add stage. The overlap-add stage is configured for reducing an influence of a detected transient or for not using the detected transients when adding.

According to another embodiment, an apparatus for processing an audio signal, comprises an analysis filterbank for generating subband signals; a time manipulator for individually time manipulating a plurality of subband signals, the time manipulator comprising: an overlap-add stage for overlapping and adding blocks of the subband signal using an overlap-add-advance value being different from a block extraction advance value; a transient detector for detecting a transient in the audio signal or a subband signal, wherein the overlap-adder stage is configured for reducing an influence of a detected transient or for not using the detected transients when adding; and a transient adder for adding a detected transient to a signal generated by the overlap/add stage.

According to another embodiment, a method for processing an audio signal comprises:

Individually time manipulating a plurality of subband signals of the audio signal, the time manipulating comprising:

Overlapping and adding blocks of a corresponding one of the plurality of subband signals using an overlap-add advance value being different from a block extraction advance value;

Detecting a transient in the audio signal or a subband signal;

Either reducing an influence of or discarding a detected transient when overlapping and adding;

Adding a detected transient to a plurality of signals generated by the action of overlapping and adding.

Another embodiment relates to a computer program for performing a method when the computer program runs on a computer, the method comprising:

Individually time manipulating a plurality of subband signals of the audio signal, the time manipulating comprising:

Overlapping and adding blocks of a corresponding one of the plurality of subband signals using an overlap-add advance value being different from a block extraction advance value;

Detecting a transient in the audio signal or a subband signal;

Either reducing an influence of or discarding a detected transient when overlapping and adding;

Adding a detected transient to a plurality of signals generated by the action of overlapping and adding.

According to related embodiments, the apparatus may further comprise a decimator for decimating the audio signal or the plurality of audio signals. The time manipulator may be configured for performing a time stretching of the plurality of subband signals.

According to a further embodiment, the transient detector may be configured to mark blocks detected as comprising a transient; and in which the plurality of overlap-add stages is configured to ignore the marked blocks.

According to a further embodiment, the plurality of overlap-add stages may be configured for applying an overlap-add value being greater than a block extraction value for performing a time stretching of the plurality of subband signals.

According to a further embodiment, the time manipulator may further comprise a block extractor, a windower/phase adjustor, and a phase calculator for calculating a phase, based on which the windower/phase adjustor performs the adjustment of an extracted block.

According to a further embodiment, the transient adder may be further configured to insert a portion of the subband signal having the transient, wherein the length of the portion is selected sufficiently long, such that a cross-fade from the signal output from the portion having the transient to the output from the overlap-add-processing is possible.

According to a related embodiment, the transient adder may be configured for performing the cross-fade operation.

According to a further embodiment, the transient detector may be configured for detecting blocks extracted by a block extractor from the subband signal having a transient characteristic. The overlap-add stage may be further configured for reducing an influence of the detected blocks or for not using the detected blocks when adding.

According to a further embodiment, the transient detector may be configured for performing a moving center of gravity calculation of energy across a predetermined time period of a signal to be input into an analysis filterbank or a subband signal.

Exact determination of the position of the transient for the purpose of selecting an appropriate section, can, for example, be performed with the help of a moving centroid calculation of the energy across an appropriate time period. In particular, transient determination can be performed in a frequency-selective manner within a filter bank. Additionally, the time period of the section can be selected as a constant value or in a variable manner based on information from the transient determination.

According to a further embodiment, the apparatus may further comprise an analysis filterbank for generating the subband signals.

According to a further embodiment, the apparatus may further comprise a decimator arranged at an input side or an output side of the analysis filter bank. The time manipulator may be configured for performing a time stretching of the plurality of subband signals.

According to a further embodiment, the apparatus may further comprise a first analysis filterbank, a second analysis filter bank, a resampler upstream of the second analysis filter bank, and a plurality of phase vocoders for a second plurality of subband signals output by the second analysis filterbank, the plurality of phase vocoders having a bandwidth extension factor greater than one and a phase vocoder output being provided to the plurality of overlap-add stages.

According to a further embodiment, the apparatus may further comprise a connecting stage between the first analysis bank and the plurality of phase vocoders at an input side of the connecting stage and the plurality of overlap-add stages at an output stage of the connecting stage, the connecting stage being configured to control a provision of the blocks of the corresponding one of the plurality of subband signals and phase-vocoder processed signal to the overlap-add stage.

According to a further embodiment, the apparatus may further comprise: an amplitude correction configured to compensate for amplitude affecting effects of different overlap values.

The present application thus provides different aspects of apparatuses, methods or computer programs for processing audio signals in the context of bandwidth extension and in the context of other audio applications which are not related to bandwidth extension. The features of the described and claimed individual aspects can be partly or fully combined, but can also be used separately from each other, since the individual aspects already provide advantages with respect to perceptual quality, computational complexity and processor/memory resources when implemented in a computer system or micro processor.

According to the teachings disclosed herein, and in contrast to existing methods, a windowed section including the transient may be removed from the signal to be manipulated. This may be obtained by summing up only those time portions not including transients, block by block, during the overlap-and-add (OLA) process. This results in a time stretched signal including no transients. After terminating the time stretching, the unstretched transients that have been removed from the original signal are added again.

Dispersion and echo effects hence no longer affect the subjective audio quality of the transient.

By inserting the original signal portion, change of timbre or pitch will result when changing the sampling rate. Generally, however, the transient psycho-acoustically masks this. If, in particular, stretching by an integer factor takes place, the timbre will be changed only slightly, since outside the environment of the transient, only every n-th (n=stretching factor) harmonic is mapped.

The accompanying drawings are included to provide a further understanding of embodiments and are incorporated in and constitute a part of this specification. The drawings illustrate embodiments and, together with the description, serve to explain the principles of the embodiments. Other embodiments and many of the intended advantages of embodiments will be readily appreciated, as they become better understood with reference to the following detailed description. Like reference numerals designate corresponding or similar parts.

DETAILED DESCRIPTION OF THE INVENTION

Figure 1:
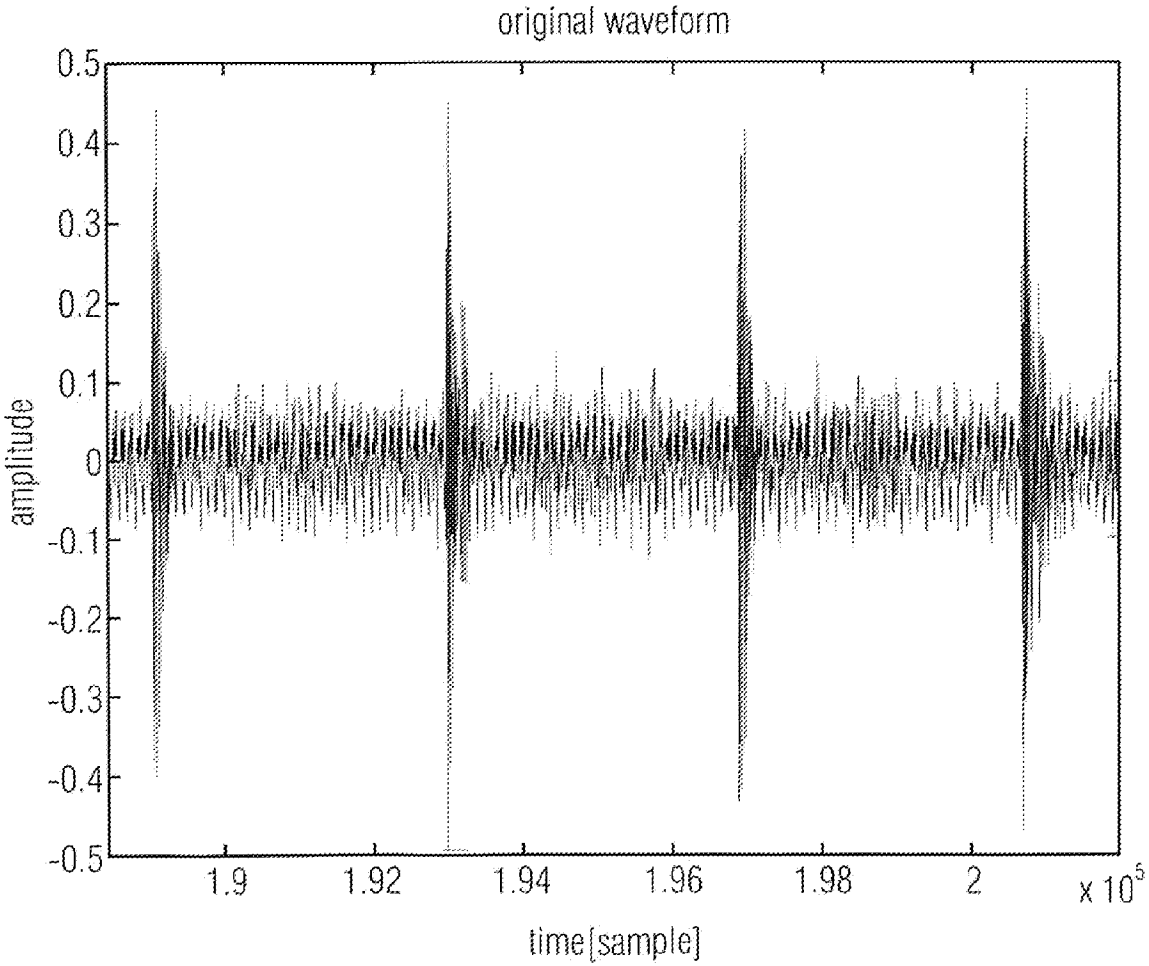
FIG. 1 shows a signal waveform of an original signal consisting exemplarily of a mixture of pitch pipe and castanets.

FIG. 1 shows a time section of a signal waveform of an audio signal consisting exemplarily of a mixture of pitch pipe and castanets. The depicted audio signal shall be used as an original signal on which various time stretching actions are performed without or with applying the teachings disclosed herein. The sound of the pitch pipe corresponds to a substantially periodic signal having an amplitude of approximately 0.08 units in FIG. 1. Four castanet beats are visible in FIG. 1 as four short impulses having an amplitude of approximately 0.45 units. The pitch pipe produces a substantially tonal signal. The castanets, however, produce a highly transient signal. In acoustics and audio, a transient is typically defined as a short-duration signal that represents a non-harmonic attack phase of a musical sound or spoken word. It may contain a high degree of non-periodic components and a higher magnitude of high frequencies than the harmonic content of that sound. Transients typically do not directly depend on the frequency of the tone they initiate.

Figure 2:
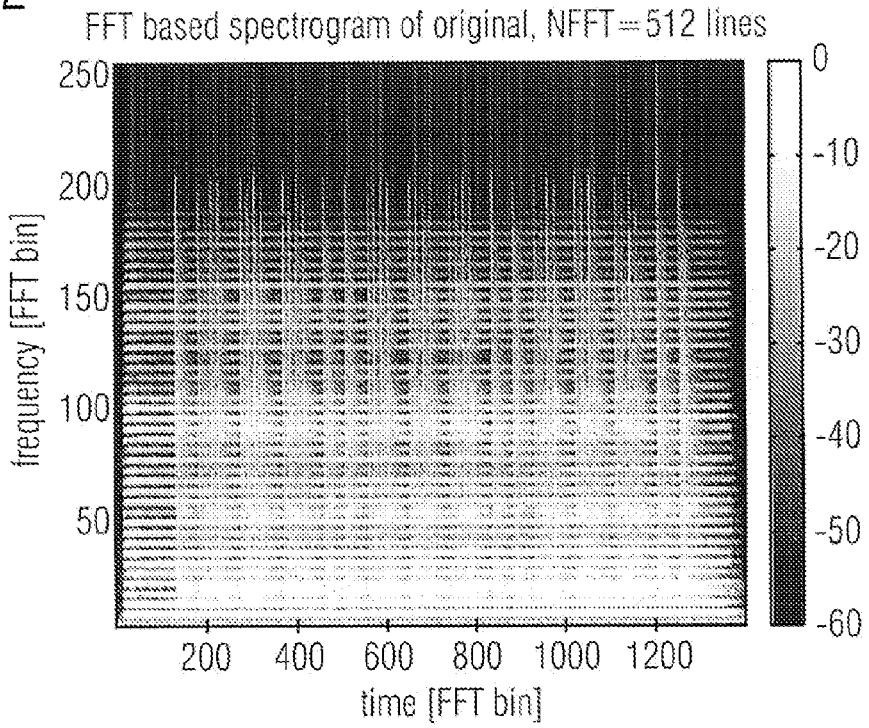
FIG. 2 shows a Discrete Fourier Transformation (DFT) spectrogram of the signal waveform shown in FIG. 1.
Figure 3:
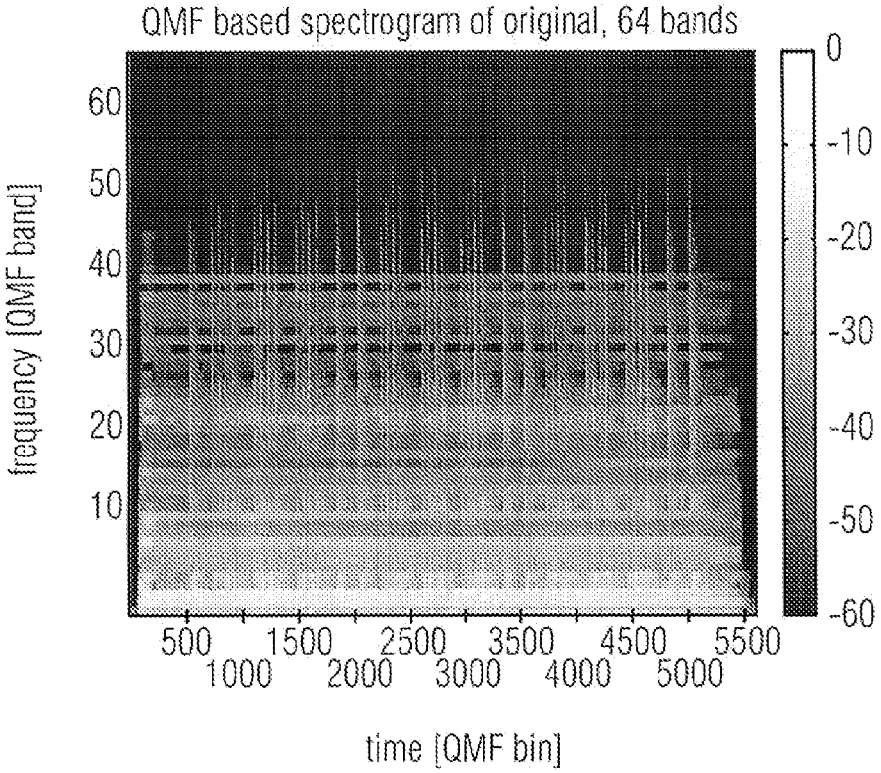
FIG. 3 shows a QMF based spectogram based on a 64 band pQMF analysis filterbank similar to the DFT spectrogram FIG. 2.

FIG. 2 shows a Discrete Fourier Transform (DFT) spectrogram of the signal waveform of FIG. 1. FIG. 3 is similar to FIG. 2 and shows a 64 band pseudo-Quadrature Mirror filterbank (pQMF) spectrogram of the signal waveform of FIG. 1. As can be seen from the two spectrogram illustrations in FIGS. 2 and 3, the original audio signal includes a dense harmonic partial sound structure (horizontal structures) and castanet beats (vertical structures).

Figure 4:
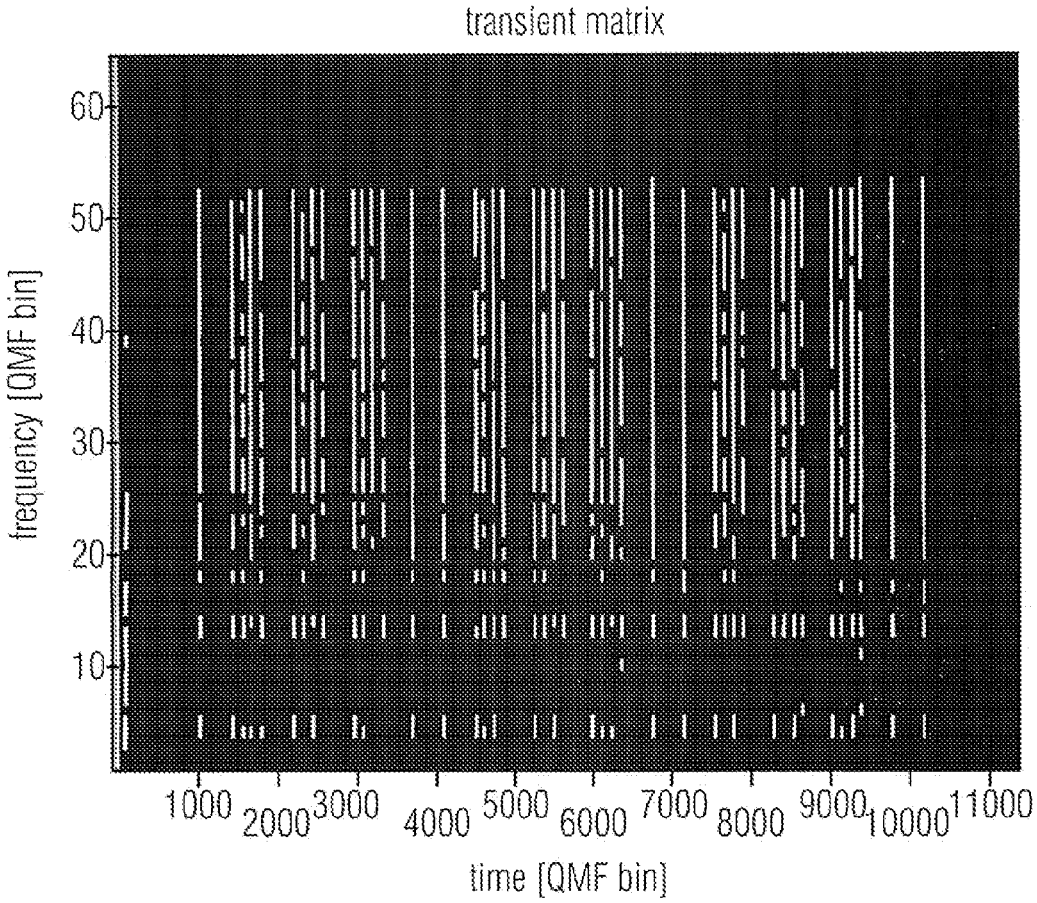
FIG. 4 shows a transient detection matrix.
Figure 5:
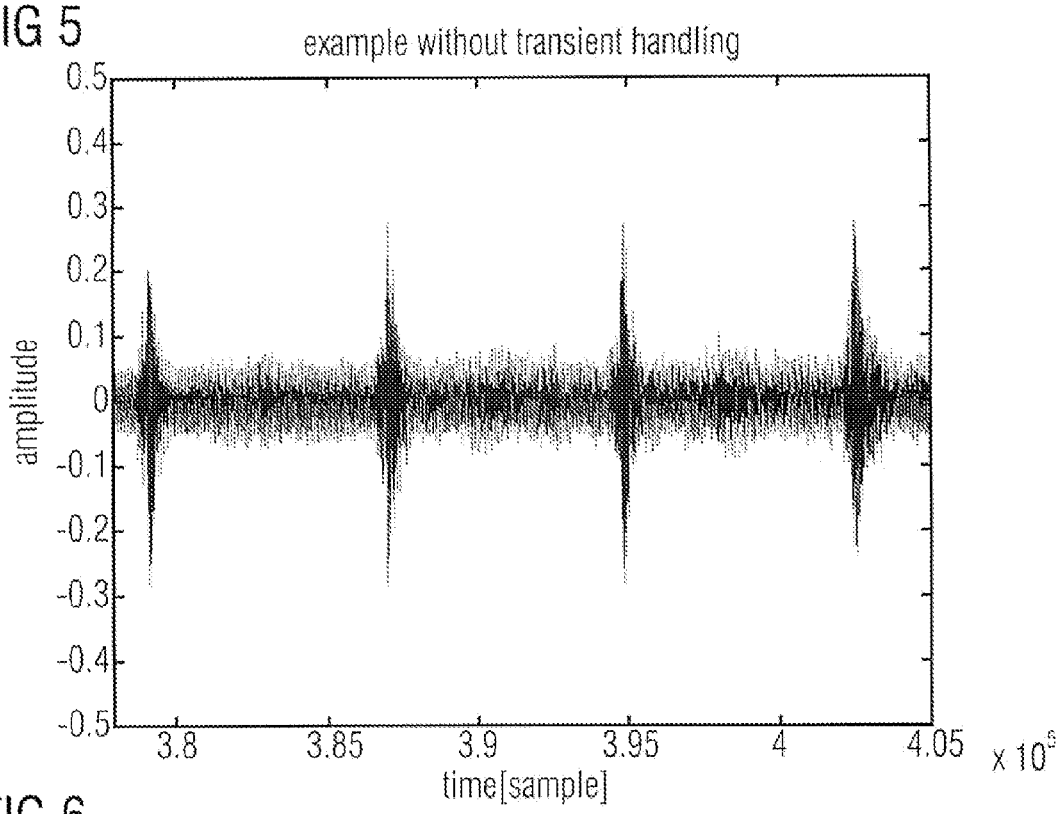
FIG. 5 shows a signal waveform of a signal resulting from time stretching without using the teachings disclosed herein.
Figure 6:
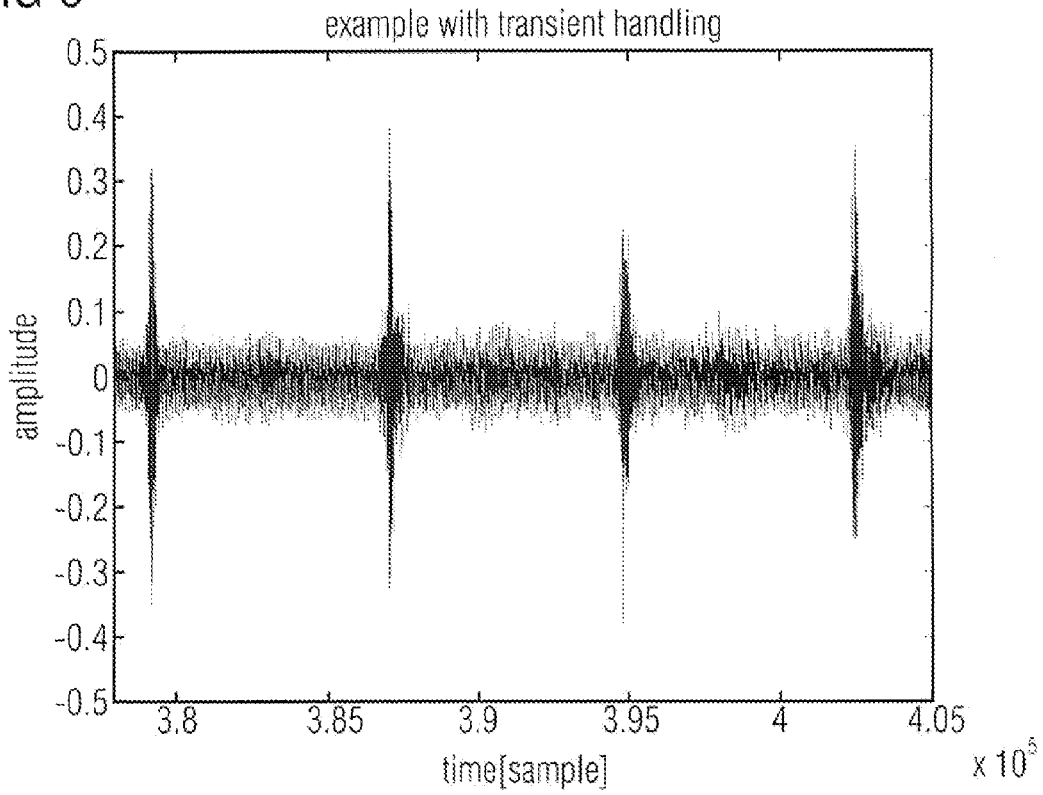
FIG. 6 shows a signal waveform of a signal resulting from time stretching with using the teachings disclosed herein.
Figure 7:
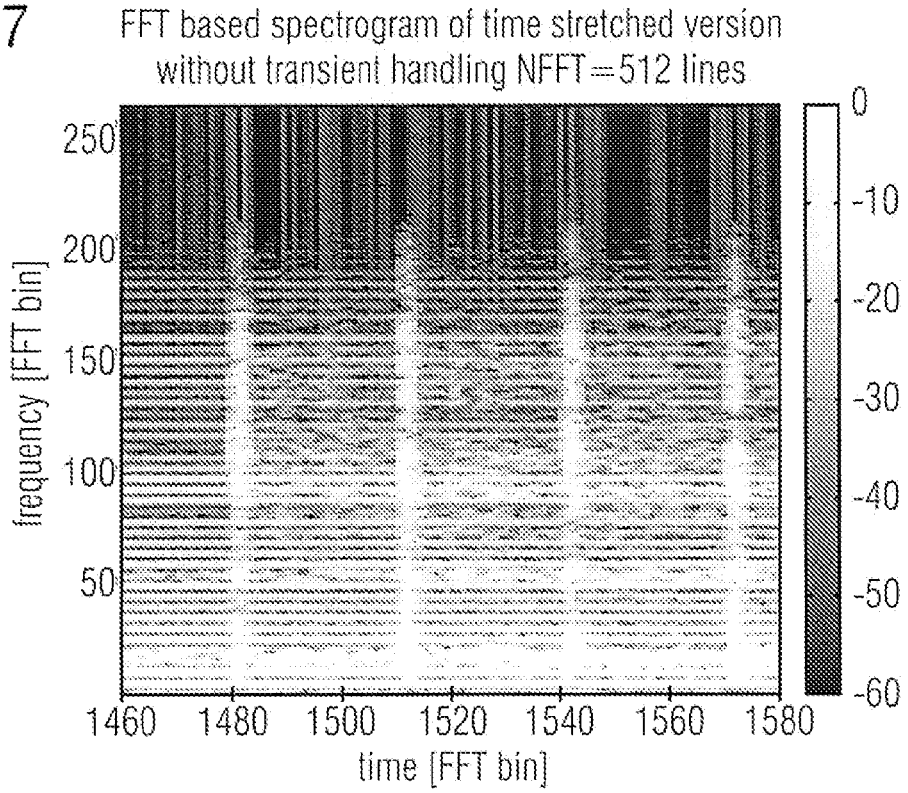
FIG. 7 shows an FFT based spectrogram of a time stretched signal without transient handling according to the teachings disclosed herein.
Figure 8:
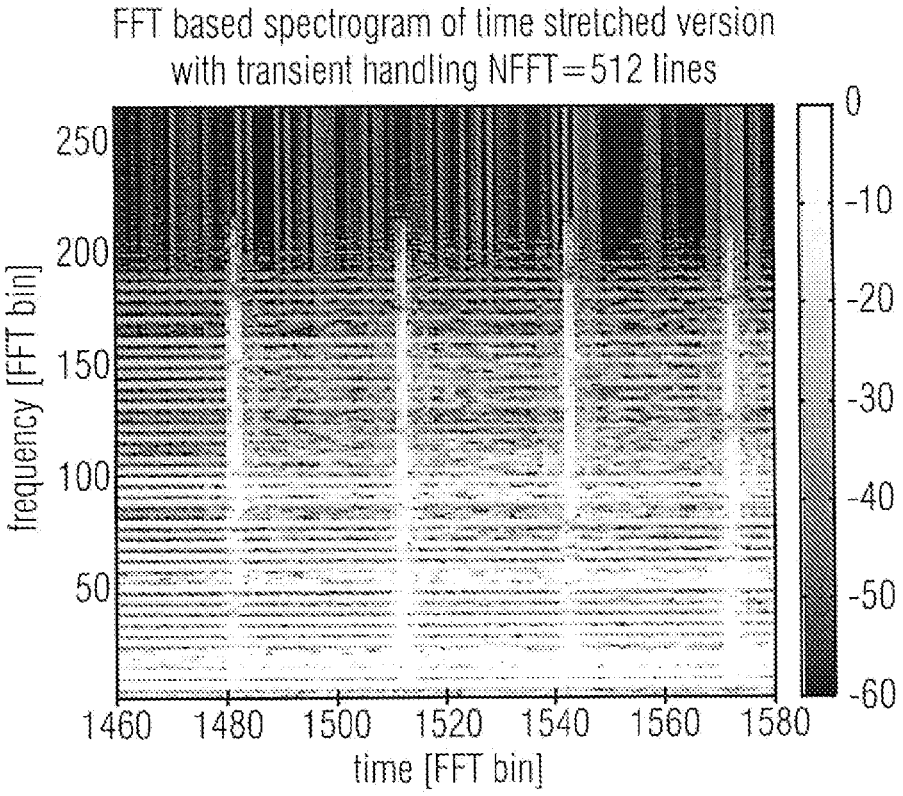
FIG. 8 shows an FFT based spectrogram of a time stretched signal with transient handling according to the teachings disclosed herein.

Derived there from, FIG. 4 shows a binary transient detection matrix marking transient signal portions in a frequency-selective manner. Detected transient signal portions are illustrated in white. The same may be removed via vocoder for transposition and subsequently added again based on the original signal. Alternatively, the detected transient signal portions may be excluded from time stretching and replaced later with respective signal portions from the original signal.

FIGS. 5 to 8 show the result of time stretching with and without the new transient handling in the form of two time signals and the associated spectrograms. By comparing the time signals and the spectrograms for the cases with transient handling and without transient handling, it can be seen that undesired time blur of the transient signal portions is effectively avoided by employing the teachings disclosed herein. For example, the time signal shown in FIG. 5 and the corresponding spectrogram shown in FIG. 7 reveal that the castanet beats have been widened, i.e. their duration is longer than in the original time signal shown in FIG. 1. In contrast, the time signal shown in FIG. 6 and the corresponding spectrogram in FIG. 8, which have been obtained by employing a transient handling according to the teachings disclosed herein, demonstrate that the castanet beats have not undergone a substantial widening with respect to their duration but are substantially preserved during the course of the signal manipulation.

With the apparatus, method, and computer program according to the disclosed teachings, artifacts (dispersions, pre and post echoes) resulting when processing transients by time stretching and transposition methods, are effectively avoided. Above that, it is differentiated in a frequency-selective manner whether stationary or transient portions in a subband predominate, and the transient handling method is selected correspondingly. Additionally, the time period of the signal portion to be inserted can be formed in a variable manner considering parameters of transient determination for optimally adapting the time period of the signal portion to the transient.

The method is suitable for all audio applications where the replay speed of audio signals or their pitch is to be changed. Particularly suited are applications for bandwidth extension or in the field of audio effects.

Figure 9:
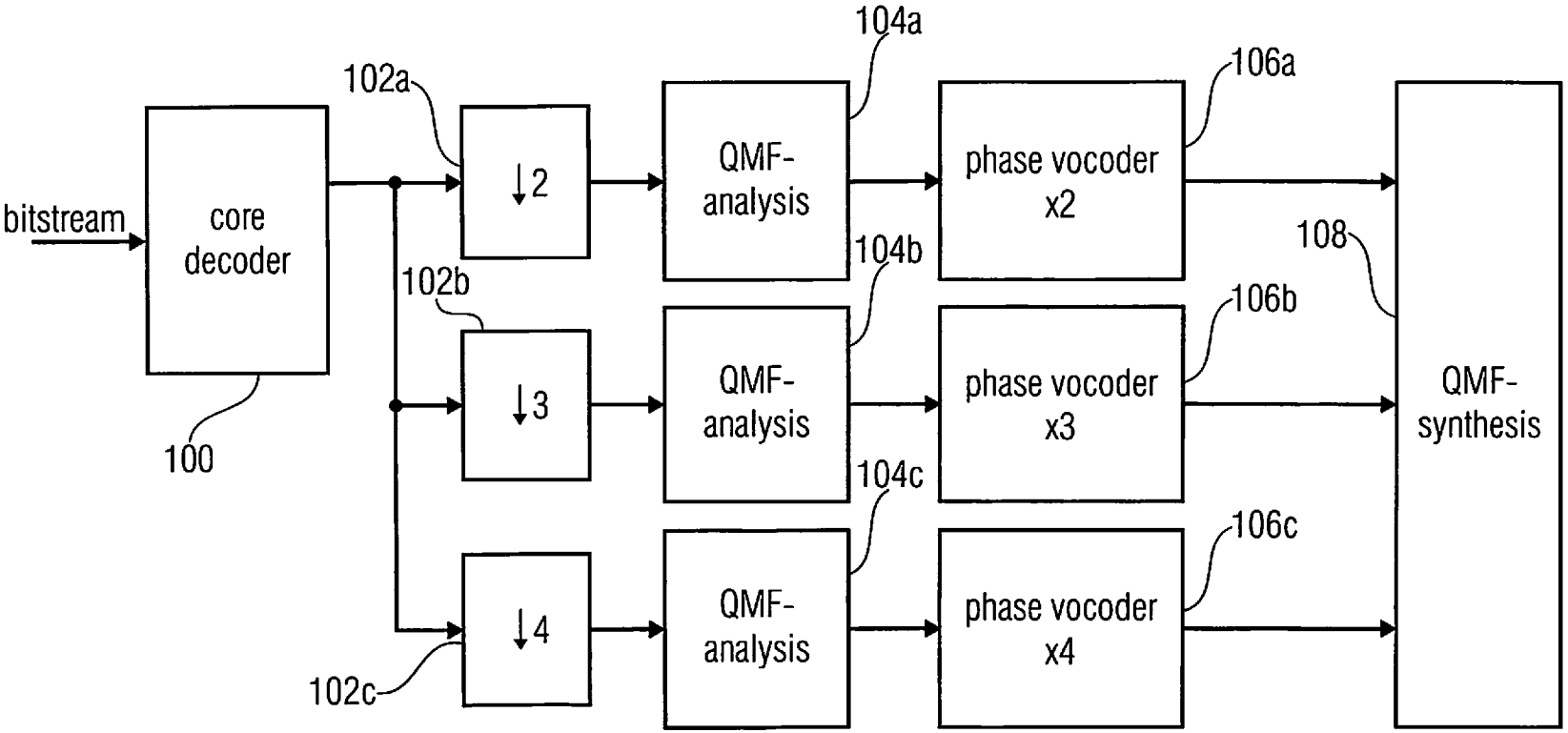
FIG. 9 illustrates a schematic block diagram of an audio processing system comprising an apparatus according to the teachings disclosed herein.

FIG. 9 illustrates an audio processing system which is in the field of audio bandwidth extension. However, the invention can also be applied to other fields as well which do not perform a bandwidth extension. A bitstream is input into a core decoder 100. The signal output by the core decoder, i.e., a narrow bandwidth audio signal is input into respective decimators 102*a*, 102*b*, 102*c*. The decimated signals which have a reduced time length compared to the signal output by the core decoder 100 are input into corresponding pQMF analysis stages 104*a*, 104*b*, 104*c*. The stages 104*a*, 104*b*, 104*c* can be implemented by any other analysis filterbank which is not a pQMF filterbank. Plenty of different filterbank implementations exist which all can be used for this purpose.

Each pQMF analysis stage 104*a*, 104*b*, 104*c* outputs a plurality of different subband signals in different subband channels, where each subband signal has a reduced bandwidth and, typically, a reduced sampling rate. In this case, the filterbank is a 2-times oversampled filterbank which is advantageous for the present invention. However, also a critically sampled filterbank may be used.

The corresponding narrow band signal or subband signal output in a pQMF analysis channel is input into a phase vocoder. Although FIG. 9 only illustrates three phase vocoders 106*a*, 106*b*, 106*c*, it is important to see that each individual pQMF analysis channel may have an own phase vocoder. The phase vocoder algorithm can also be implemented by interpolation of the base band or the first patch. The phase vocoders for different subband signals generated by the same analysis filterbank, have a similar construction, and are different from the phase vocoders for the subband signals from other filterbanks due to the bandwidth extension factor illustrated in FIG. 9. The bandwidth extension factor is two in the phase vocoder 106*a*. In the phase vocoder 106*b*, the bandwidth extension factor is three, and in the phase vocoder 106*c*, the bandwidth extension factor is four. Note that it typically not necessary for the purposes of the teachings disclosed herein to perform any bandwidth extension or even several different bandwidth extensions. Thus, the decimators 102*a*, 102*b*, 102*c* may be omitted. The outputs from the different phase vocoders are input into a pQMF synthesis filterbank 108. When the analysis filterbanks in blocks 104*a*-104*c* are implemented in a different technology, then the synthesis filterbank 108 will also be implemented in a different technology, so that the analysis filterbank technology and the synthesis filterbank technology match with each other.

An apparatus according to the teachings disclosed herein may be implemented in a distributed manner in one or more of the QMF analysis stages 104*a*, 104*b*, 104*c* and the QMF synthesis filterbank 108. In the same manner or a similar manner, a time manipulator which is a part of the apparatus according to the disclosed teachings may be distributed aming the QMF analysis stages 104*a*, 104*b*, 104*c* and the QMF synthesis filterbank 108. Accordingly, the one or more of the QMF analysis stages 104*a*, 104*b*, 104*c* may omit blocks containing a transient from time manipulation and forward the original blocks to the synthesis filterbank 108. The synthesis filterbank 108 may provide the functionality of a transient adder by adding a detected and typically unmodified transient to a signal generated by an overlap-add stage of the synthesis filterbank 108. The schematic block diagram of FIG. 9 does not explicitly show the transient detector. The transient detector could be part of the QMF analysis stages 104*a*, 104*b*, 104*c*. In the alternative, the transient detector could be a unit of its own.

Figure 10:
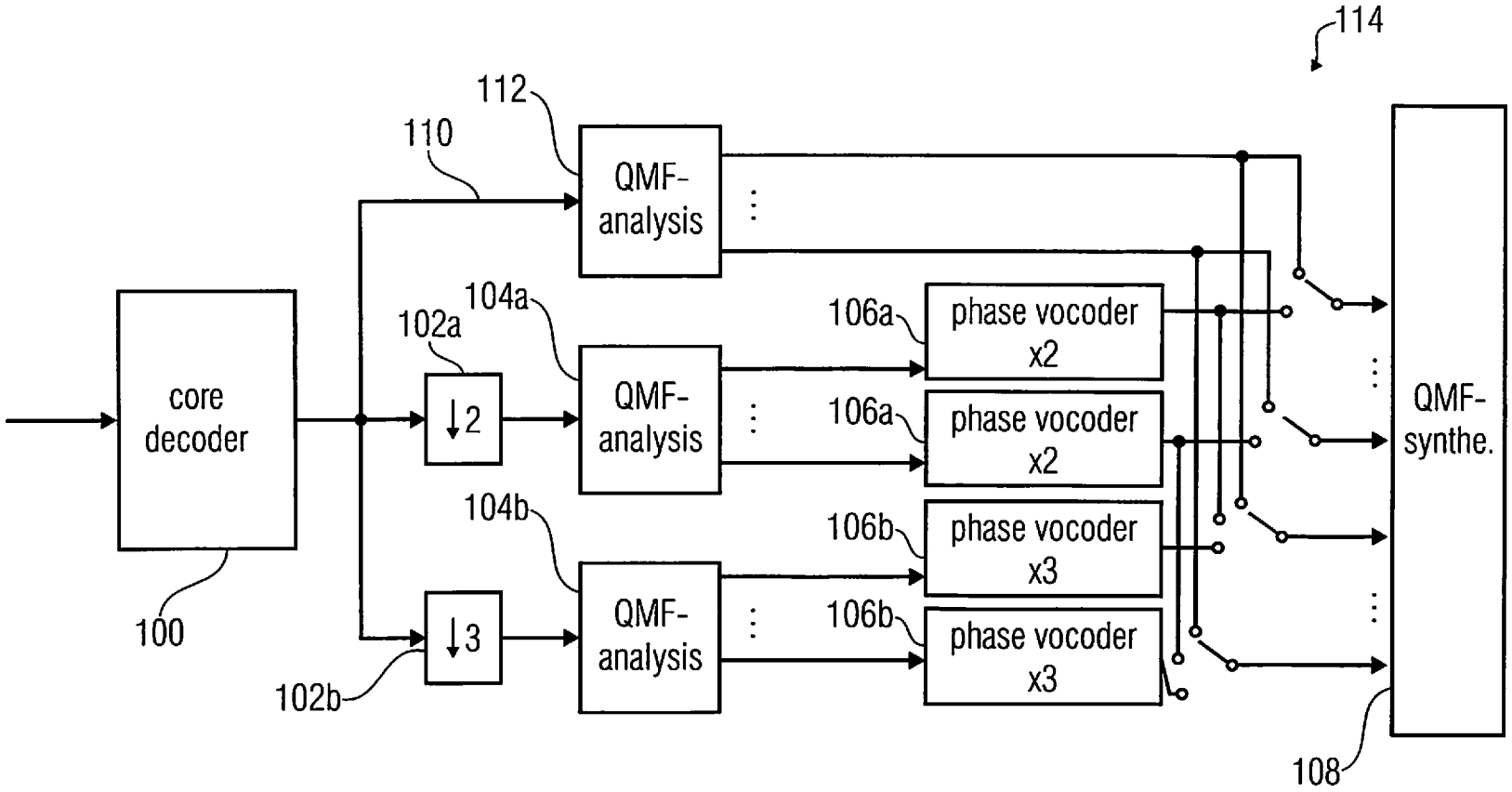
FIG. 10 illustrates a schematic block diagram of another audio processing system comprising an apparatus according to the teachings disclosed herein.

FIG. 10 illustrates the different implementation, where the baseband signal on line 110 is input into an analysis filterbank 112. Thus, the lowband signal is transformed into a plurality of subband signals. Additionally, a switching stage or connecting stage 114 is provided, by which different subband signals output by a phase vocoder 106*a*, 106*b* or output by the baseband pQMF analysis 112 can be input into any arbitrarily selected synthesis band.

The individual phase vocoders are related to an individual pQMF band. In FIG. 10, the first pQMF band and the last pQMF band of a first harmonic patch using the bandwidth extension factor of two are illustrated as 106*a*. For the other harmonic patch using the bandwidth extension factor of three, the first and the last pQMF band of this patch are illustrated as 106*b*.

The synthesized signal can be generated using an arbitrarily selected combination of phase vocoder outputs and baseband pQMF analysis 112 outputs. It is to be noted that the switching stage 114 can be a controlled switching stage which is controlled by an audio signal having a certain side information, or which is controlled by a certain signal characteristic. Alternatively, the stage 114 can be a simple connecting stage without any switching capabilities. This is the case, when a certain distribution of output signals from elements 112 and 106*a*-106*b* is fixedly set and fixedly programmed. In this case, the stage 114 will not comprise any switches, but will comprise certain through-connections.

Figure 11A:
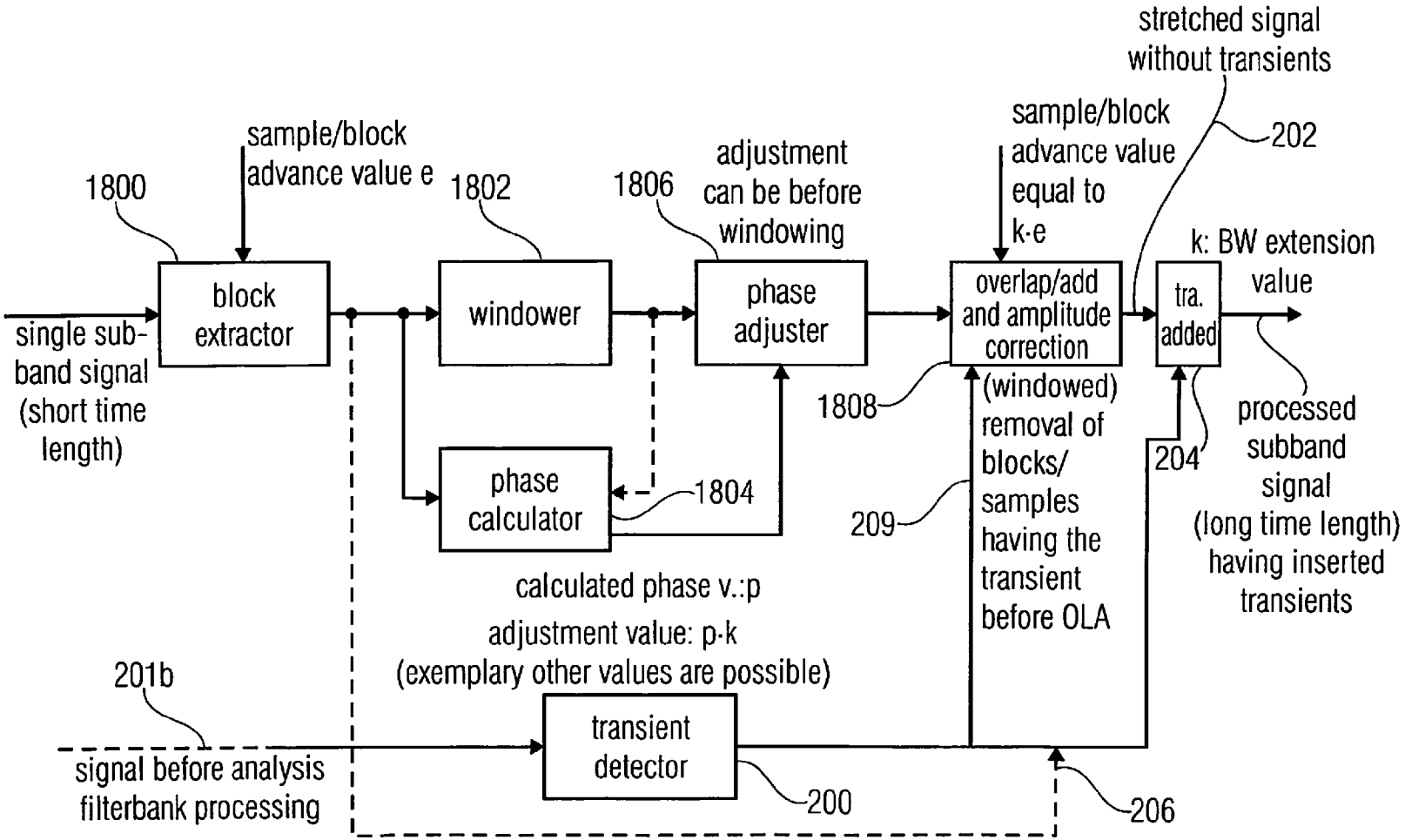
FIG. 11A illustrates a schematic block diagram of a processing implementation for processing a single subband signal.

FIG. 11A illustrates an embodiment of a processing implementation for processing a single subband signal. The single subband signal may have been subjected to any kind of decimation either before or after being filtered by an analysis filter bank not shown in FIG. 11A. In case a decimation has been performed, the time length of the single subband signal is typically shorter than the time length before forming the decimation. The single subband signal is input into a block extractor 1800. The block extractor 1800 in FIG. 11A operates using a sample/block advance value exemplarily called e. The sample/block advance value can be variable or can be fixedly set and is illustrated in FIG. 11A as an arrow into block extractor box 1800. At the output of the block extractor 1800, there exists a plurality of extracted blocks. These blocks are highly overlapping, since the sample/block advance value e is significantly smaller than the block length of the block extractor. An example is that the block extractor extracts blocks of 12 samples. The first block comprises samples 0 to 11, the second block comprises samples 1 to 12, the third block comprises samples 2 to 13, and so on. In this embodiment, the sample/block advance value e is equal to 1, and there is a 11-fold overlapping. The above example has values, which are provided by way of example and can change from application to application.

The individual blocks are input into a windower 1802 for windowing the blocks using a window function for each block. Additionally, a phase calculator 1804 is provided which calculates a phase for each block. The phase calculator 1804 can either use the individual block before windowing or subsequent to windowing. Then, a phase adjustment value p×k is calculated and input into a phase adjuster 1806. The phase adjuster applies the adjustment value to each sample in the block. Furthermore, the factor k is equal to the bandwidth extension factor. When, for example, the bandwidth extension by a factor 2 is to be obtained, then the phase p calculated for a block extracted by the block extractor 1800 is multiplied by the factor 2 and the adjustment value applied to each sample of the block in the phase adjustor 1806 is p multiplied by 2. This is a value/rule provided by way of example. Alternatively, the corrected phase for synthesis is k*p, p+(k−1)*p. So in this example the correction factor is either 2, if multiplied or 1*p if added. Other values/rules can be applied for calculating the phase correction value.

In an embodiment, the single subband signal is a complex subband signal, and the phase of a block can be calculated by a plurality of different ways. One way is to take the sample in the middle or around the middle of the block and to calculate the phase of this complex sample.

Although illustrated in FIG. 11A in the way that a phase adjustor operates subsequent to the windower, these two blocks can also be interchanged, so that the phase adjustment is performed to the blocks extracted by the block extractor and a subsequent windowing operation is performed. Since both operations, i.e., windowing and phase adjustment are real-valued or complex-valued multiplications, these two operations can be summarized into a single operation using a complex multiplication factor which, itself, is the product of a phase adjustment multiplication factor and a windowing factor.

The phase-adjusted blocks are input into an overlap/add and amplitude correction block 1808, where the windowed and phase-adjusted blocks are overlap-added. Importantly, however, the sample/block advance value in block 1808 is different from the value used in the block extractor 1800. Particularly, the sample/block advance value in block 1808 is greater than the value e used in block 1800, so that a time stretching of the signal output by block 1808 is obtained. Thus, the processed subband signal output by block 1808 has a length which is longer than the subband signal input into block 1800. When the bandwidth extension of two is to be obtained, then the sample/block advance value is used which is two times the corresponding value in blocks 1800. This results in a time stretching by a factor of two. When, however, other time stretching factors are needed, then other sample/block advance values can be used so that the output of block 1808 has a needed time length.

For addressing the overlap issue, an amplitude correction is advantageously performed in order to address the issue of different overlaps in block 1800 and 1808. This amplitude correction could, however, be also introduced into the windower/phase adjustor multiplication factor, but the amplitude correction can also be performed subsequent to the overlap/processing.

In the above example with a block length of 12 and a sample/block advance value in the block extractor of one, the sample/block advance value for the overlap/add block 1808 would be equal to two, when a bandwidth extension by a factor of two is performed. This would still result in an overlap of six blocks. When a bandwidth extension by a factor of three is to be performed, then the sample/block advance value used by block 1808 would be equal to three, and the overlap would drop to an overlap of four. When a four-fold bandwidth extension is to be performed, then the overlap/add block 1808 would have to use a sample/block advance value of four which would still result in an overlap of more than two blocks.

The phase vocoder for an individual subband signal illustrated in FIG. 11A advantageously comprises a transient detector 200 for performing a transient detection within the subband signal indicated by connection 201*a* or for performing a transient detection of the signal before the analysis filterbank processing as indicated by connection line 201*b*. As soon as the transient detector 200 detects the transient, the overlap/add stage is controlled to not use the blocks having the transient in the overlap/add processing as illustrated by control connection 203. In an embodiment, the signal on line 203 controls the overlap/add stage to remove all blocks having the transient event. This will result in a signal at the output of this stage which is stretched with respect to the signal before this stage, but which does not include any transients.

The stretched signal without transients is input into the transient adder which is configured for adding the transient to the stretched signal so that, at the output, there exists a stretched signal having inserted transients, but these inserted transients have not been affected by a multiple overlap/add processing.

In one embodiment, the transient portion is inserted from the subband signal itself as illustrated by connection line 206 and line 201*a*. Alternatively, the signal can be taken out from any other subband signal or from the signal before the subband analysis, since it is characteristic for a transient that the transient occurs in a quite similar manner over the individual subbands. On the other hand, however, using the transient event occurring in a subband is advantageous in some instances, since the sampling rate and other considerations are as close as possible to a stretched signal.

Figure 11B:
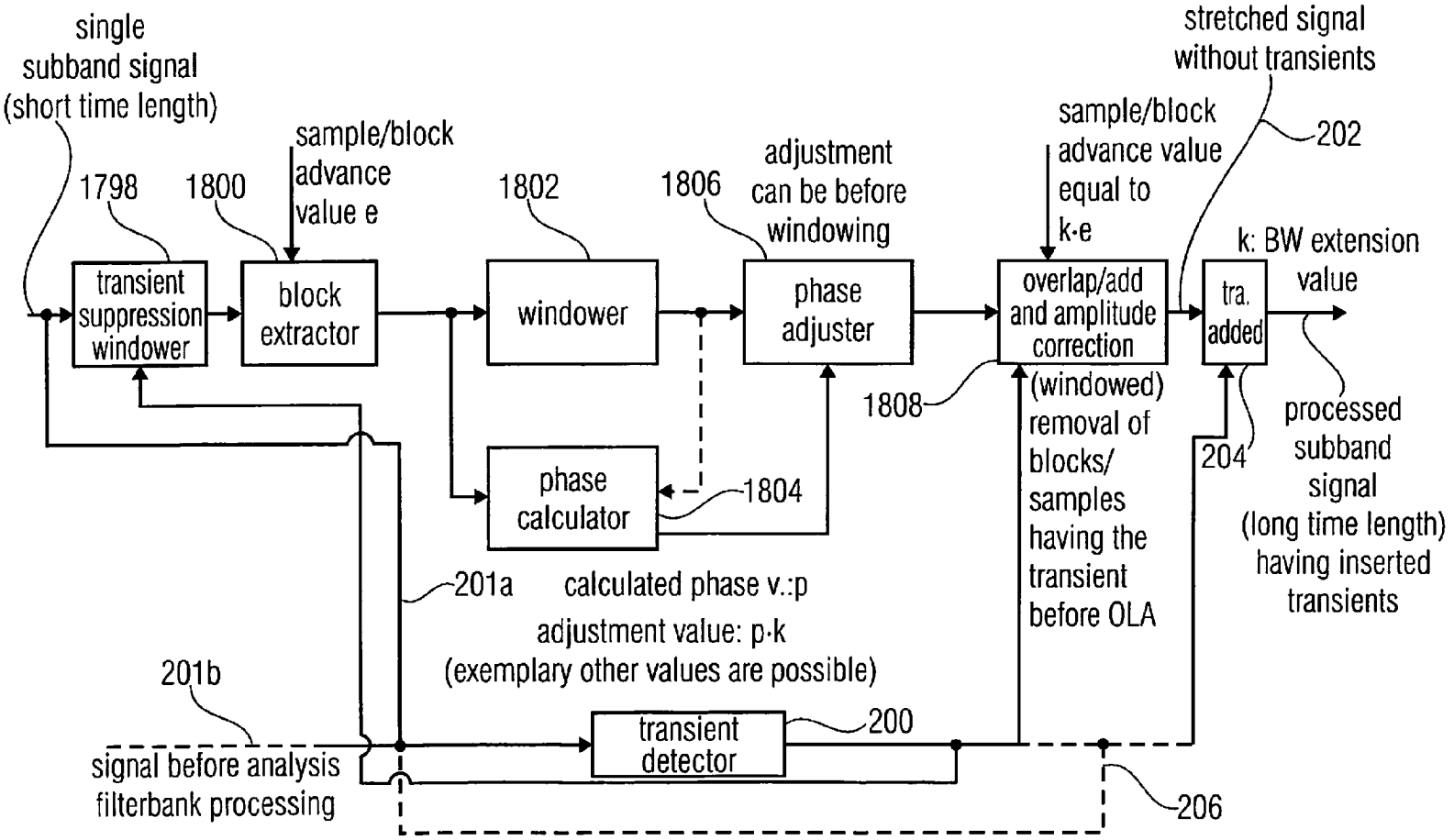
FIG. 11B illustrates a schematic block diagram of another processing implementation for processing a single subband signal.

FIG. 11B illustrates another possible embodiment of a processing implementation for processing a single subband signal. Upstream of the block extractor 1800, a transient suppression windower 1798 is inserted which acts on the single subband signal. The transient suppression windower 1798 removes samples or blocks containing a transient. An evaluation whether a sample contains a transient is performed by the transient detector 200. The single subband signal is tapped at an input side of the transient suppression windower 1798 so that the transient detector 200 receives the single subband signal as an input. Upon detection of a transient, the transient detector 200 outputs a corresponding signal to the transient suppression windower 1798 and the transient suppression windower 1798 reacts by suppressing the sample(s) that has/have been indicated by the transient detector 200 as containing a transient. Therefore, samples marked by the transient detector 200 as containing a sample do not enter the block extractor 1800. The other, non-transient-containing samples are kept in the blocks that are processed by the block extractor 1800, the windower 1802, the phase calculator 1804, the phase adjuster 1806, and the overlap-add block 1808. The overlap-add block 1808 outputs a stretched signal without transients.

The transient-containing samples are then added again to the stretched signal without transients by the transient adder 204. The transient adder 204 receives a control signal from the transient detector 200 and the original single subband signal as inputs. With this information, the transient adder can identify the samples that have been suppressed by the transient suppression windower 1798 and re-insert these samples in the stretched signal without transients. At the output of the transient adder 204 the processed subband signal (long time length) having inserted transients is obtained.

Figure 12A:
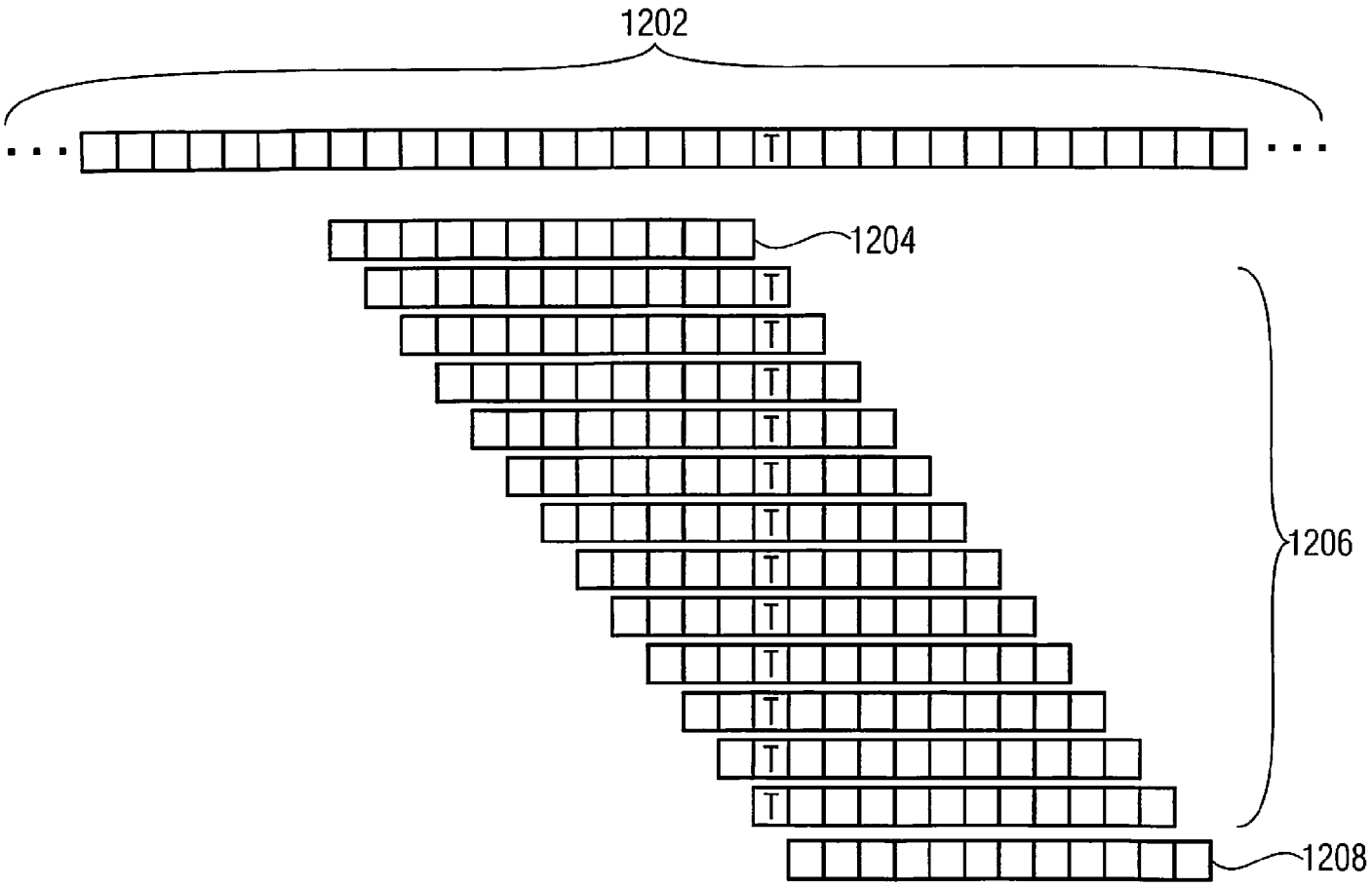
FIGS. 12A to 12E illustrate the signal block processing according to the disclosed teachings.

FIGS. 12A to 12E illustrate how the audio signal or one of the plurality of subband signals may be processed according to previously implemented methods and according to the teachings disclosed herein. In FIG. 12A, a sequence of audio samples 1202 is shown. The sequence 1202 may belong to one of the plurality of subband signals. The letter "T" marks a sample in which a transient has been detected by a transient detector.

Beneath the sequence 1202 in FIG. 12A, a plurality of extracted blocks 1206 are represented. The plurality of extracted blocks 1206 are each 12 samples long and comprise the sample with the transient T. Above and beneath the plurality of extracted blocks 1206 one preceding block 1204 and one subsequent block 1208 are shown that do not contain the transient T. As can be seen in FIG. 12A, the entire plurality of extracted blocks 1204 extends over 23 blocks.

Figure 12B:
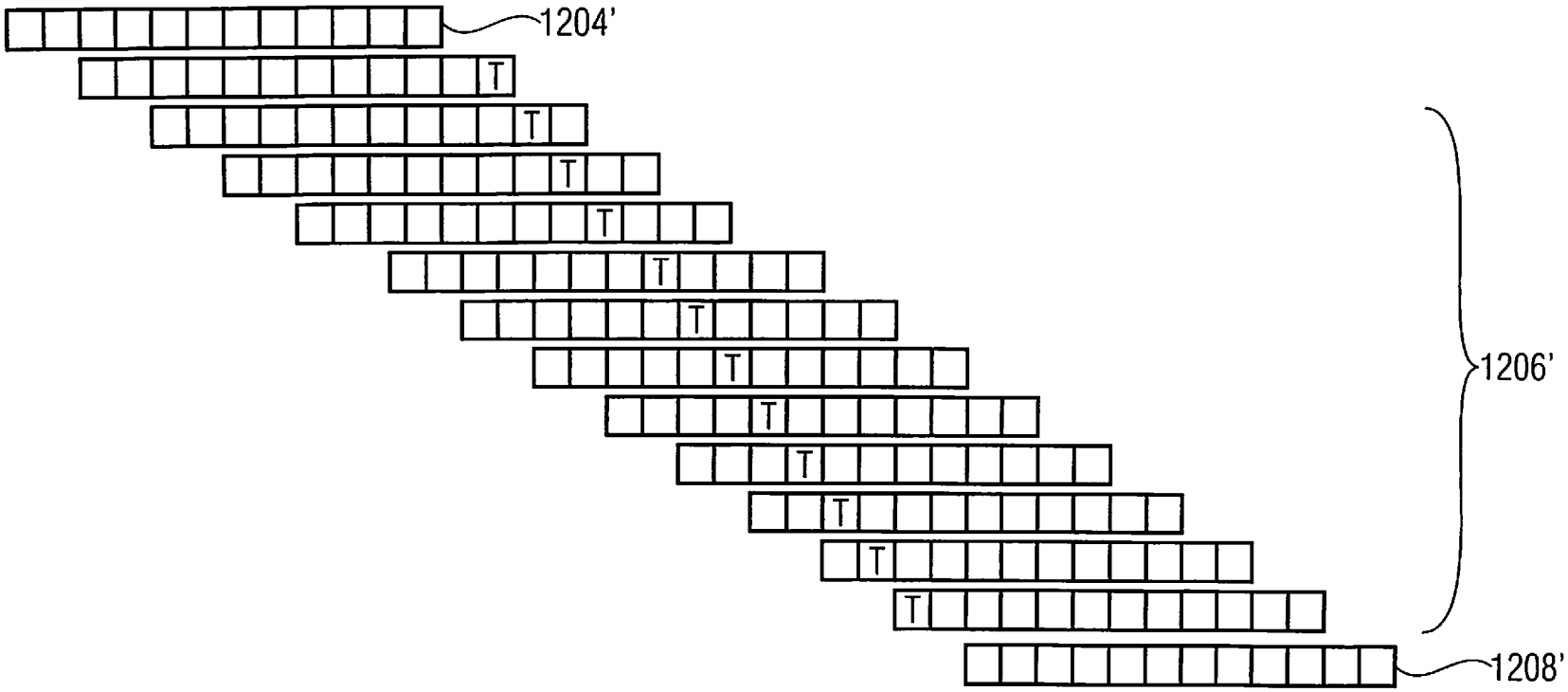

FIG. 12B illustrates how, in standard time manipulation methods, the preceding block 1204, the blocks of the plurality of extracted blocks 1206, and the subsequent block 1208 are shifted each by one block prior to overlapping and adding the individual blocks in order to perform a time stretching of the audio signal. The shifted versions of the blocks or the plurality of blocks are labeled 1204', 1206', and 1208'. The overlap-add-advance value is two in FIG. 12B, whereas the block extraction advance value illustrated in FIG. 12A is one. As a result of the shifting of the blocks, the samples comprising the transient T in the blocks of the plurality of extracted blocks 1206 are not temporally aligned anymore, but are spread over a time span of twelve samples.

Figure 12C:
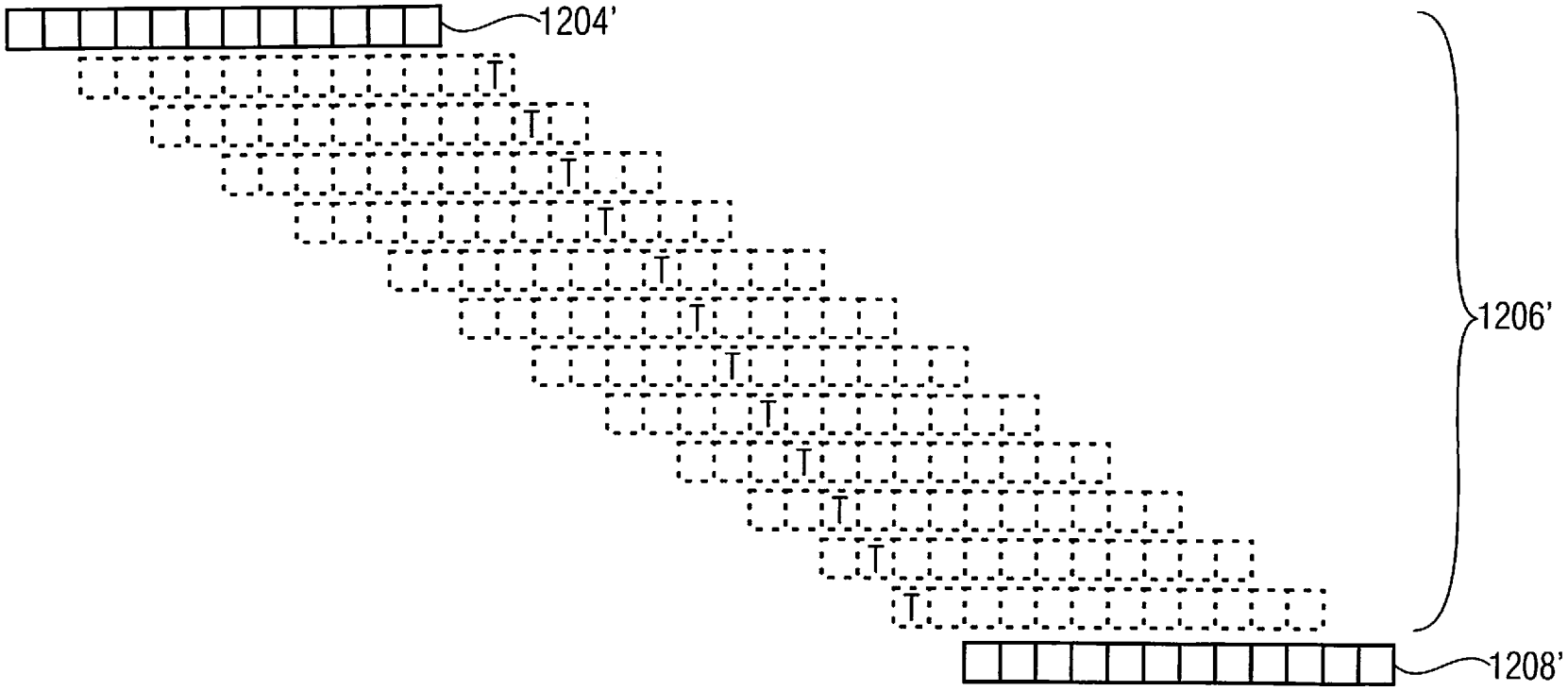

FIG. 12C illustrates a removal of the blocks that contain the transient T in one or more of their samples, in accordance with the teachings disclosed herein. The removed blocks belong to the plurality of extracted blocks 1206' and are drawn in dashed line. The removal of the blocks 1206' leaves a gap which is 14 samples long. Furthermore, in a time span of 10 samples prior to the gap and a time span of 10 samples subsequent to the gap, only a reduced number of blocks instead of the usual six blocks are considered in the overlap-add process or by the overlap-add stage of an apparatus for processing an audio signal. Note that FIGS. 12B and 12C are illustrative only and that the blocks of the plurality of extracted blocks 1206 of FIG. 12A could be removed immediately after a transient has been detected, i.e. without performing the time shifting action on these blocks of the plurality of extracted blocks 1206. In one possible implementation of the teachings disclosed herein, the blocks of the plurality of extracted blocks 1206 are rerouted to bypass the overlap-add stage and to be inserted downstream of the overlap-add stage.

Figure 12D:
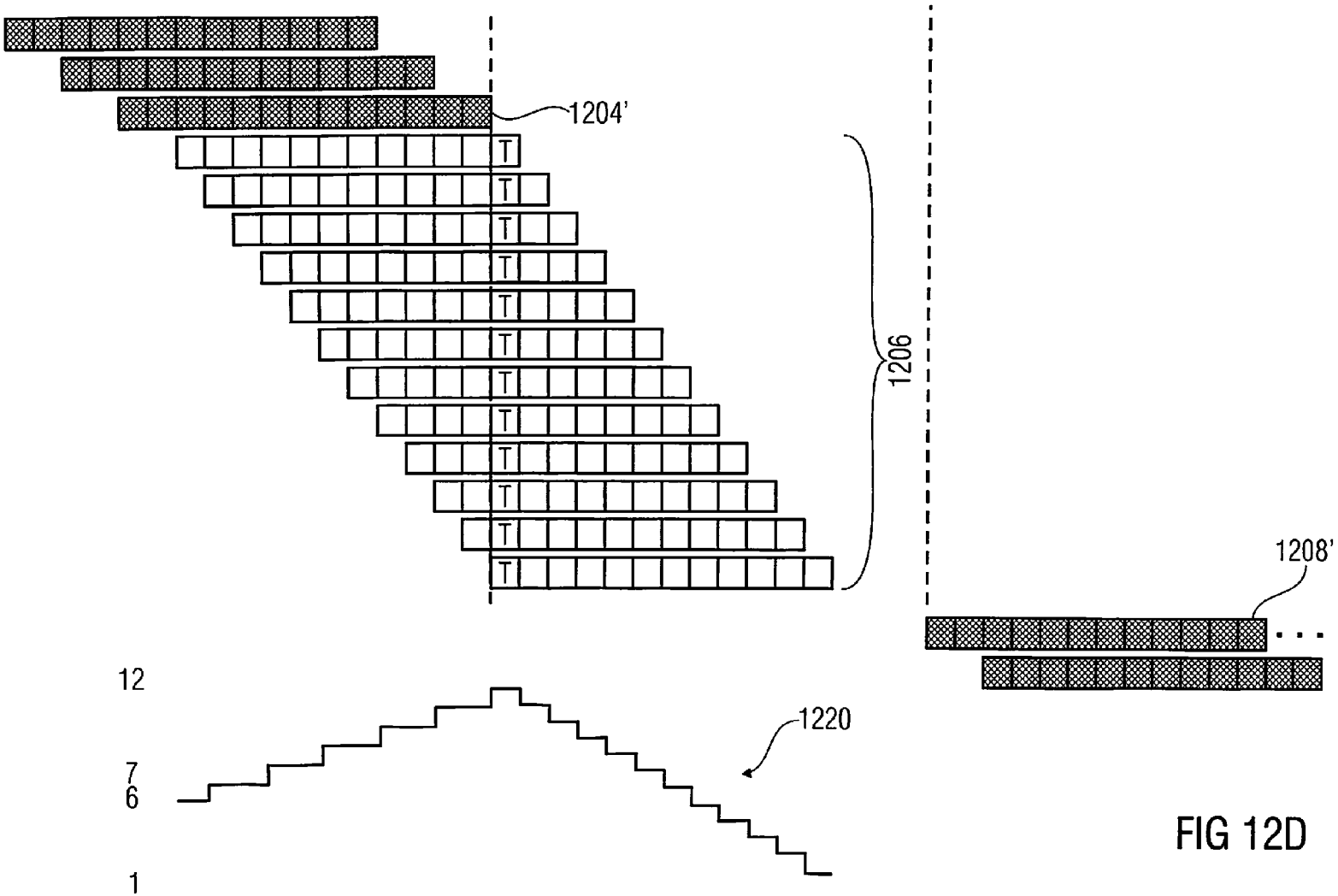

In FIG. 12D an insertion of the original transient section, i.e. the plurality of extracted blocks 1206, in the time manipulated audio signal. The original transient section is inserted in the gap that has been left after the removal of the blocks containing the transient T. The original transient section may be added to the time manipulated rest of the audio signal. At the beginning or the left edge of the gap, the plurality of extracted blocks 1206 is superposed with six regular blocks (three of which are shown in FIG. 12D, with a dot pattern). In the example depicted in FIG. 12D, the regular blocks are processed with an overlap-add-advance value of two. As can be seen in FIG. 12D, a residual gap remains between the end of the original transient section and the subsequent block 1208'. It would be possible, to shift the plurality of extracted blocks 1206 a few samples to the right, that is towards later time instants so that the original transient section is more equally distributed and/or located within the gap between the shifted preceding block 1204' and the shifted subsequent block 1208'.

The lower part of FIG. 12D shows how many blocks are superposed in each sample. According to the regular time manipulation with a block length of twelve samples, a block extraction value of one, and an overlap-add-advance value of two, six blocks are typically considered during the overlap-add process for a particular sample of the time manipulated audio signal. In other words, in one sample of the time manipulated signal there are contributions from six different blocks extracted from the original audio signal. The curve in FIG. 12D shows that during the processing of the original transient section initially six blocks are considered. As the blocks of the plurality of extracted blocks 1206 are staggered with one sample difference, the number of blocks to be superposed increases to reach the value twelve for the sample were the transient T has been detected. Subsequently, the block count decreases by one with every new sample to reach the value one at the end of the original transient section. The block count may be used to correct an amplitude of the time manipulated signal in section, in which the number of superposed blocks differs from the regular value of six. To this end, the block count may be determined based on a detection of the transient and fed to an amplitude correction. The amplitude correction may either act on the blocks prior to overlapping, adding, and/or superposing, or on the resulting time manipulated signal.

Figure 12E:
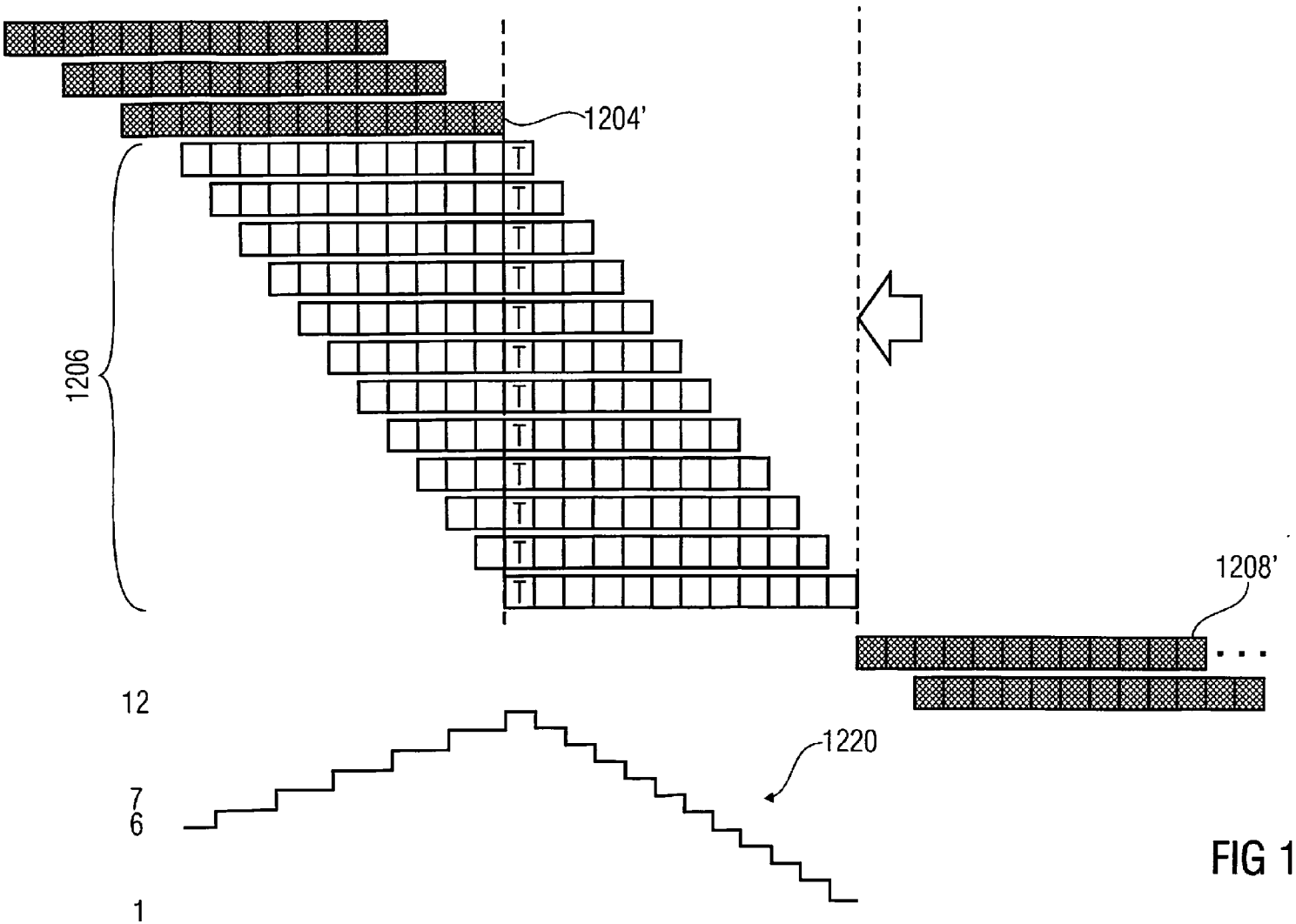

As mentioned above, a residual gap of two samples remains. When the regular blocks begin again, starting with the subsequent block 1208', FIG. 12E shows an optional implementation in which the gap has been shortened by two samples so that no residual gap remains between the end of the original transient section and the shifted subsequent block 1208'. Although this measure may lead to a slight corruption of the resulting time manipulated signal (in particular, a slight shortening), the effect may be negligible. As mentioned above, the original transient section could be inserted more centered within the gap between the previous block 1204' and the subsequent block 1208'.

As an alternative to removing complete blocks that comprise one or more transient-containing samples, as illustrated in FIGS. 12A to 12E, the individual transient-containing sample(s) may be removed within the block, while the remaining samples in the block are maintained. The removal of the transient-containing samples may be implemented by setting a value of the sample to zero. Hence, the transient-containing sample will not make a contribution to the output of the overlap-add block 1808. An amplitude correction may be used in order to increase a contribution of the other samples that are overlap-added with the zeroed sample. The action of zeroing the transient-containing samples may be accompanied by fading-out and fading-in the subband signal prior to the sample and subsequent to the sample, respectively. For example, a few samples prior to the transient-containing sample and a few samples subsequent to the transient containing sample the subband signal may be multiplied with a fading factor signal in order to implement e.g. a triangular fading window around the transient-containing sample (s).

Figure 13:
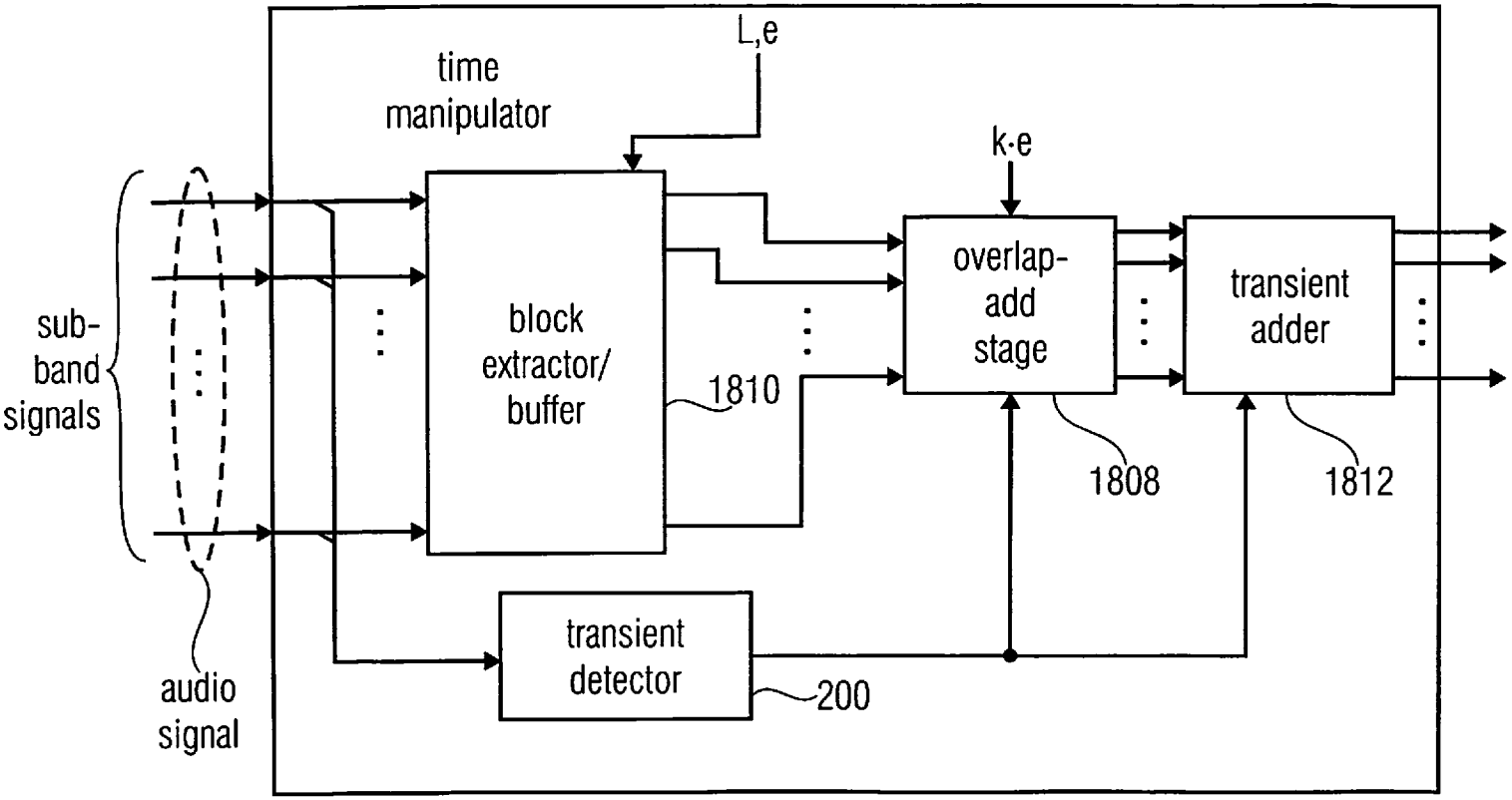
FIG. 13 illustrates a schematic block diagram of an apparatus according to one embodiment of the teachings disclosed herein.

FIG. 13 shows a schematic block diagram of a time manipulator that could be a part of an apparatus for processing an audio signal according to the disclosed teachings. The time manipulator receives a plurality of subband signals which together form the audio signal. Within the time manipulator the plurality of subband signals may be temporarily stored by a block extractor and buffer 1810. The block extractor and buffer 1810 extracts blocks from the each one of the plurality of subband signals. The blocks have a specific block length L and are extracted with a specific block extraction advance value e. For example, the block length L may be twelve and the block extraction advance value e may be one. The block extractor and buffer 1810 receives the block length L and the block extraction advance value e as input parameters. In the alternative, the block length L and the block extraction advance value e could be stored in a fixed manner in the block extractor and buffer 1810.

The block extractor and buffer 1810 outputs extracted blocks and provides them to an overlap-add stage 1808 in which the extracted blocks are overlapped with an overlap-add-advance value k*e different from the block extraction advance value e and added up to form the time manipulated audio signal. The overlap-add stage 1808 may comprise a plurality of overlap-add units, e.g. one overlap-add unit for a corresponding one of the plurality of subband signals. Another option would be to use a single overlap-add stage or a few overlap-add units in a time-sharing or multiplexed manner so that the subband signals are overlap-added individually and successively.

The time manipulator further comprises a transient detector 200 which receives the plurality of subband signals. The transient detector 200 may analyze the subband signals or the audio signal with respect to e.g. a non-harmonic attack phase of a musical sound or spoken word or a high degree of non-periodic components and/or a higher magnitude of high frequencies than the harmonic content of that sound. An output of the transient detector 200 indicates whether or not a transient has been identified in a current section of the audio signal and is provided to the overlap-add stage 1808 and a transient adder 1812. In case the output of the transient detector 200 indicates that a transient has been detected, the overlap-add stage 1808 is controlled to ignore those blocks that contain the transient T when performing the overlap-add action. The transient adder 1812, on its part, inserts the original transient section to the otherwise time-manipulated audio signal upon reception of an indication from the transient detector 200 that a transient has been detected. The time-manipulated signal with the added transient forms an output of the time manipulator.

Figure 14:
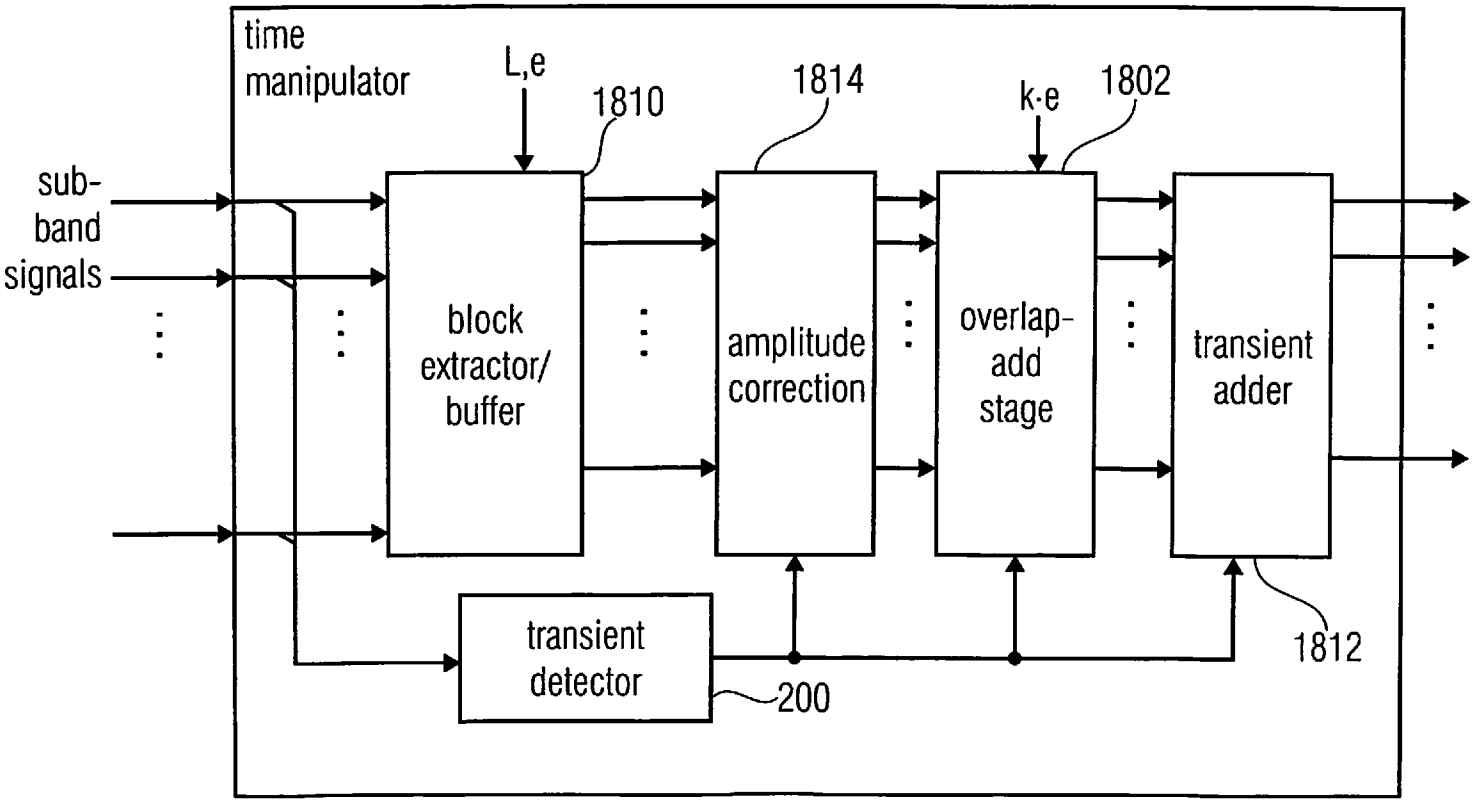
FIG. 14 illustrates a schematic block diagram of an apparatus according to another embodiment of the teachings disclosed herein.

FIG. 14 shows a schematic block diagram of a time manipulator according to another implementation according to the teachings disclosed herein. In addition to the elements of the time manipulator shown in FIG. 13, the time manipulator of FIG. 14 comprises an amplitude correction 1814. The amplitude correction 1814 receives the indication about a detected transient from the transient detector 200. On the basis of this information, the amplitude correction 1814 may modify the amplitude of signal blocks to account for a varying number of blocks that are being used in the overlap-add process. The variation of the number of blocks considered is due to the removal of the plurality of extracted blocks 1204 and possibly due to the insertion of the original transient section. Typically, the time pattern how the number of blocks varies is known and can be determined on the basis of the time instant of the detected transient. Hence, it may be sufficient to provide a trigger signal to the amplitude correction which then adjusts the amplitudes of subsequent blocks according to the time pattern. A possible time pattern could be based on the waveform showing the evolution of the number of blocks that are considered in the overlap-add process as illustrated in FIGS. 12D and 12E. An amplitude correction value could be, for example, a reciprocal of the block count.

Figure 15:
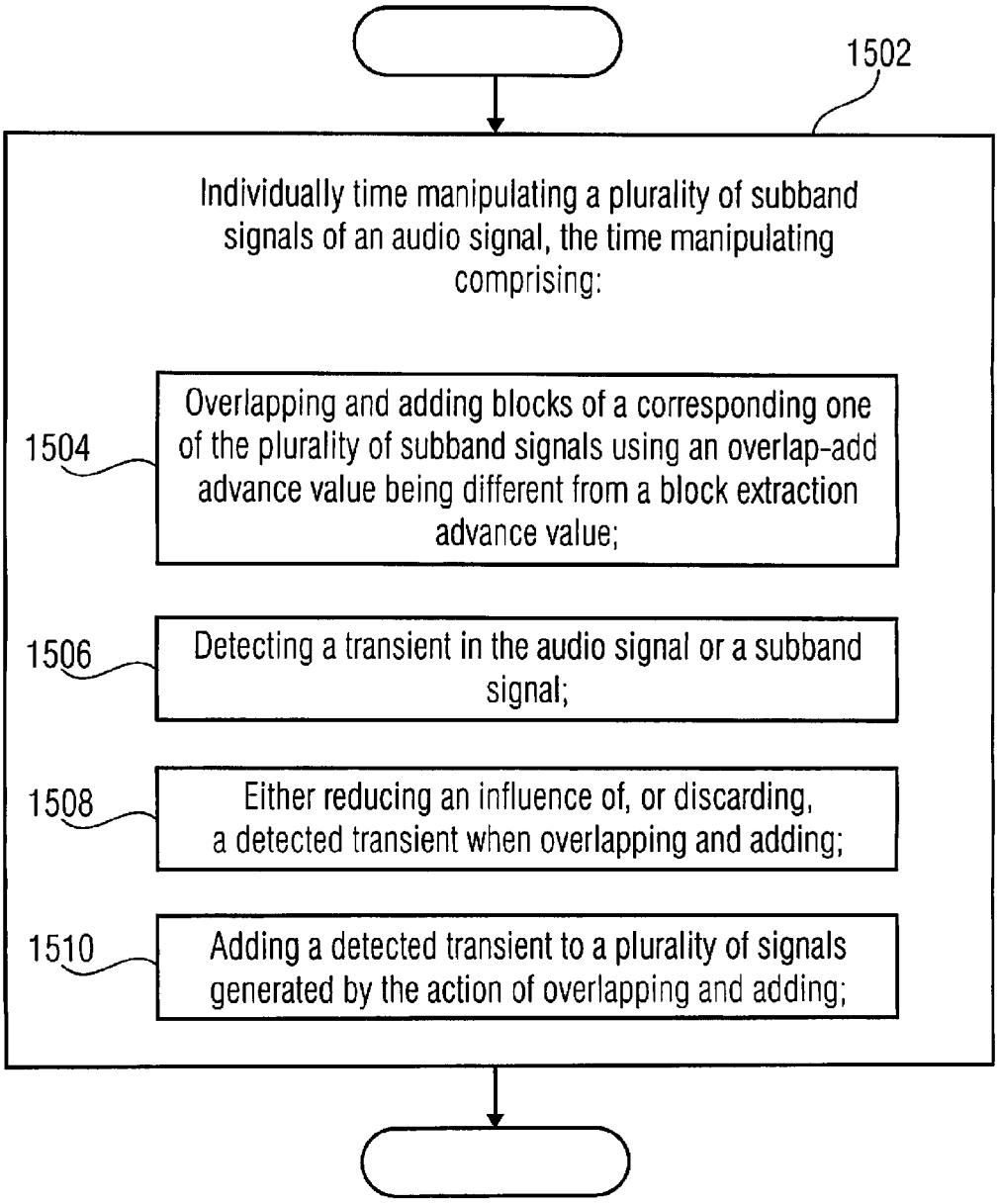
FIG. 15 illustrates a schematic flow diagram of a method for processing an audio signal according to the teachings disclosed herein.

FIG. 15 shows a schematic flow diagram of a method for processing an audio signal according to the teachings disclosed herein. After the start of the method, an action 1502 is performed in which a plurality of subband signals of an audio signal are individually time-manipulated. The action 1502 comprises sub-actions 1504 to 1510.

At 1504 the blocks of a corresponding subband signal of the plurality of subband signals are overlapped and added. An overlap-add advance value is used that is different from a block extraction advance value. The action 1504 represents the normal process flow in the absence of transients and is performed continuously.

A transient detection action is performed at 1506 to detect a transient in the audio signal or in a subband signal. The action 1506 may be performed concurrently with the action 1504 and other actions shown in the flow diagram of FIG. 15.

An influence of a detected transient is either reduced, or the detected transient is discarded, when performing the action 1504 of overlapping and adding.

A detected transient is then added, at action 1510, to a plurality of signals generated by the action 1504 of overlapping and adding.

Although according to the teachings disclosed herein the transient section of the audio signal has typically not undergone the same time manipulation as the rest of the audio signal, the time-manipulated resulting signal typically renders the transient sections in a realistic manner. This may be at least partly due to the fact that a transient is highly insensitive to many signal manipulation methods, such as frequency shifting.

According to another aspect of the teachings disclosed herein, an apparatus for processing an audio signal may comprise:

an analysis filterbank for generating subband signals;

a time manipulator for individually time manipulating a plurality of subband signals, the time manipulator comprising:

an overlap-add stage for overlapping and adding blocks of the subband signal using an overlap-add-advance value being different from a block extraction advance value;

a transient detector for detecting a transient in the audio signal or a subband signal, wherein the overlap-adder stage is configured for reducing an influence of a detected transient or for not using the detected transients when adding; and a transient adder for adding a detected transient to a signal generated by the overlap/add stage.

According to another aspect of the teachings disclosed herein, an apparatus as previously described, may further comprise a decimator arranged at an input side or an output side of the analysis filterbank, wherein the time manipulator may be configured for performing a time stretching of a subband signal.

According to another aspect of the teachings disclosed herein, in an apparatus as previously described, the transient detector may be configured to mark blocks detected as comprising a transient; and the overlap-adder-stage may be configured to ignore the marked blocks.

According to another aspect of the teachings disclosed herein, in an apparatus as previously described, the overlap-add-stage may be configured for applying an overlap-add-advance value being greater than a block-extraction-advance value for performing a time stretching of the subband signal.

According to another aspect of the teachings disclosed herein, in an apparatus in accordance with one of the preceding claims, the time manipulator may comprise: a block extractor; a windower/phase adjustor; and a phase calculator for calculating a phase, based on which the windower/phase adjuster performs the phase adjustment of an extracted block.

According to another aspect of the teachings disclosed herein, in an apparatus as previously described, the transient detector may be configured to determine a length of a portion of the subband signal containing the transient, the length matching the length of the signal to be inserted by the transient adder.

According to another aspect of the teachings disclosed herein, in an apparatus as previously described, the transient adder may be configured to insert a portion of the subband signal having the transient, wherein the length of the portion may be selected sufficiently long, such that a cross-fade from the signal output from the overlap-add-processing to the portion having the transient or from the portion having the transient to the output from the overlap-add-processing is possible.

According to another aspect of the teachings disclosed herein, in an apparatus as previously described, the transient adder may be configured for performing the cross-fade operation.

According to another aspect of the teachings disclosed herein, in an apparatus as previously described, the transient detector may be configured for detecting blocks extracted by a block extractor from the subband signal having a transient characteristic, and the overlap-add-stage may be configured for reducing an influence of the detected blocks or for not using the detected blocks when adding.

According to another aspect of the teachings disclosed herein, in an apparatus as previously described, the transient detector may be configured for performing a moving center of gravity calculation of an energy across a predetermined time period of a signal to be input into an analysis filterbank or a subband signal.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon which cooperate (or are capable of cooperating) with a programmable computer system such that the respective method is performed.

Some embodiments according to the invention comprise a data carrier having electronically readable control signals which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Apparatus for processing an audio signal, comprising:

an analysis filterbank for generating subband signals of the audio signal;

a time manipulator for individually time manipulating a plurality of subband signals representing the audio signal, the time manipulator comprising:

an overlap-add stage for overlapping and adding blocks of at least one of the plurality of subband signals using an overlap-add-advance value different from a block-extraction-advance value used for extracting the blocks from a subband signal of the plurality of subband signals;

a transient detector for detecting a transient in the audio signal or the at least one subband signal of the plurality of subband signals, wherein the overlap-add stage is configured for reducing an influence of a detected transient or for not using the detected transients in a subband-individual manner when adding by the overlap-add stage; and a transient adder for adding a detected transient to the at least one subband signal generated by the overlap/add stage in a subband-individual manner.

2. Apparatus in accordance with claim 1, further comprising a decimator for decimating the audio signal or the plurality of subband signals, wherein the time manipulator is configured for performing a time stretching of the plurality of subband signals.

3. Apparatus in accordance with claim 1, in which the transient detector is configured to mark blocks detected as comprising a transient in a subband-individual manner; and in which the overlap-add-stage is configured to ignore the marked blocks.

4. Apparatus in accordance with claim 1, in which the overlap-add-stage is configured for applying an overlap-add-advance value being greater than a block-extraction-advance value for performing a time stretching of the plurality of subband signals.

5. Apparatus in accordance with claim 1, in which the time manipulator further comprises:

a block extractor;

a windower/phase adjustor; and a phase calculator for calculating a phase, based on which the windower/phase adjuster performs the phase adjustment of an extracted block.

6. Apparatus in accordance with claim 1, in which the transient detector is configured to determine a length of a portion of the subband signal comprising the transient, the length matching the length of the signal to be inserted by the transient adder.

7. Apparatus in accordance with claim 1, in which the transient adder is configured to insert a portion of the subband signal comprising the transient, wherein the length of the portion is selected sufficiently long, such that a cross-fade from the signal output from the overlap-add-processing to the portion comprising the transient or from the portion comprising the transient to the output from the overlap-add-processing is possible.

8. Apparatus in accordance with claim 7, in which the transient adder is configured for performing the cross-fade operation.

9. Apparatus in accordance with claim 1, in which the transient detector is configured for detecting blocks extracted by a block extractor from the subband signal comprising a transient characteristic.

10. Apparatus in accordance with claim 1, in which the transient detector is configured for performing a moving center of gravity calculation of an energy across a predetermined time period of a signal to be input into an analysis filterbank or a subband signal.

11. Apparatus in accordance with claim 1, further comprising an analysis filter bank for generating the plurality of subband signals.

12. Apparatus in accordance with claim 11, further comprising a decimator arranged at an input side or an output side of the analysis filter bank, wherein the time manipulator is configured for performing a time stretching of the plurality of subband signals.

13. Apparatus in accordance with claim 1, further comprising:

a first analysis filter bank;

a second analysis filter bank;

a resampler upstream of the second analysis filter bank; and a plurality of phase vocoders for a second plurality of subband signals output by the second analysis filter bank, the plurality of phase vocoders comprising a bandwidth extension factor greater than one, wherein a phase vocoder output is provided to the overlap-add stage.

14. Apparatus in accordance with claim 13, further comprising a connecting stage between the first analysis filter bank and the plurality of vocoders at an input side of the connecting stage and the overlap-add stage at an output side of the connecting stage, the connecting stage being configured to control a provision of the blocks of the corresponding one of the plurality of subband signals and phase-vocoder processed blocks output by the plurality of phase vocoders to the overlap-add stage.

15. Apparatus in accordance with claim 1, further comprising:

an amplitude correction configured to compensate for amplitude affecting effects of varying block counts in the context of the overlap-add stage.

16. Apparatus in accordance with claim 1, further comprising a time manipulator for individually time manipulating the plurality of subband signals of the audio signal, wherein the time manipulator comprises the overlap-add stage, the transient detector, and the transient adder.

17. Method for processing an audio signal, comprising:

generating a plurality of subband signals of the audio signal;

overlapping and adding blocks of a corresponding one of the plurality of subband signals representing the audio signal using an overlap-add-advance value different from a block-extraction-advance value used for extracting the blocks from a subband signal of the plurality of subband signals;

detecting a transient in the at least one subband signal of the plurality of subband signals;

either reducing an influence or discarding a detected transient when overlapping and adding in a subband-individual manner;

adding a detected transient to the at least one subband signal generated by the action of overlapping and adding in a subband-individual manner.

18. A non-transitory storage medium having stored thereon a computer program for performing a method for processing an audio signal when the computer program runs on a computer, the method comprising:

generating a plurality of subband signals of the audio signal;

overlapping and adding blocks of a corresponding one of the plurality of subband signals representing the audio signal using an overlap-add-advance value different from a block-extraction-advance value used for extracting the blocks from a subband signal of the plurality of subband signals;

detecting a transient in the at least one subband signal of the plurality of subband signals;

either reducing an influence or discarding a detected transient when overlapping and adding in a subband-individual manner;

adding a detected transient to the at least one subband signal generated by the action of overlapping and adding in a subband-individual manner.

* * * * *